US006154627A

United States Patent [19]

Iwamatsu et al.

[11] Patent Number: 6,154,627

[45] **Date of Patent: *Nov. 28, 2000**

[54] DEVELOPING APPARATUS USING ONE-COMPONENT TONER

[75] Inventors: Tadashi Iwamatsu, Nara; Kazuhiro Matsuyama, Ikoma; Toshihiko Takaya, Nara; Atsushi Inoue, Ikoma-gun; Masanori Yamada, Ikoma; Nobuyuki Azuma, Ibaraki; Takayuki Yamanaka, Tenri, all of Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/256,616

[22] Filed: Feb. 23, 1999

[30] Foreign Application Priority Data

Feb. 26, 1998 [JP] Japan ..... 10-045039

[51] Int. Cl.[7] ..... G03G 15/08

[52] U.S. Cl. ..... 399/286; 399/284

[58] Field of Search ..... 399/265, 279, 399/284, 286

[56] References Cited

U.S. PATENT DOCUMENTS

| | | | |
|---|---|---|---|
| 4,564,285 | 1/1986 | Yasuda et al. | 399/286 X |
| 4,958,193 | 9/1990 | Nojima et al. | 399/286 |
| 5,369,478 | 11/1994 | Kobayashi et al. | 399/284 X |
| 5,870,658 | 2/1999 | Goto et al. | 399/284 |
| 5,893,014 | 4/1999 | Goto et al. | 399/286 |

FOREIGN PATENT DOCUMENTS

| | | |
|---|---|---|
| 2-093671 | 4/1990 | Japan . |
| 3-087759 | 4/1991 | Japan . |

*Primary Examiner*—Susan S. Y. Lee

*Attorney, Agent, or Firm*—Renner, Otto, Boisselle & Sklar, P.P.L.

[57] ABSTRACT

An object of the present invention is to prevent an electrical breakdown of a toner layer and an occurrence of overcurrent, thereby preventing quality of image from being degraded at the time of development, when development with one-component toner is conducted using a developing roller of low resistance. The resistance value Rd of a developing roller which carries and conveys one-component toner in a manner of coming into contact with a photoconductor which bears an electrostatic latent image, is defined as $Rd=\rho d\cdot(Dd1/S1)$, wherein S1 ($cm^2$) is an area in which the developing roller comes into contact with the static image bearing member via a toner layer, Dd1 (cm) is a layer thickness of a semiconductive layer which composes the developing roller, and ρd (Ω·cm) is a volume resistivity thereof. The range of the resistance Rd is set as $10^4<Rd<10^5$ and the resistance Rt (Ω) of the toner layer is set as $Rt>5\times10^7$. By using the developing roller of low resistance, excellent development is realized and an electrical breakdown and an overcurrent can be avoided by the resistance value of the toner layer.

7 Claims, 8 Drawing Sheets

DEVELOPING APPARATUS USING ONE-COMPONENT TONER

BACKGROUND OF THE INVENTION

1. Field of the Invention

The present invention relates to a developing apparatus which visualizes an electrostatic latent image formed on an electrostatic latent image bearing member by use of toner serving as a coloring agent, specifically to a developing apparatus which utilizes a developer composed of one component as toner.

2. Description of the Related Art

An image forming apparatus such as copying machines and printers which adopts an electrophotographic system is equipped with a developing apparatus which forms an electrostatic latent image on a surface of a photoconductor serving as an image bearing member, supplies a developer such as toner serving as a coloring agent to the photoconductor for the purpose of visualizing the electrostatic latent image, and causes selective adhesion of the toner.

By the developing apparatus, an electrostatic latent image formed on the photoconductor is developed and the developed toner image is transferred onto a transfer material such as a sheet. Thereafter part of the toner which was not put to the transfer remains on the surface of the photoconductor. This remaining unnecessary toner is removed from the surface of the photoconductor so that formation of an image is subsequently carried out. For this purpose, a cleaning device for removing the toner remaining on the surface of the photoconductor after the transfer is disposed, which cleaning device includes a container for receiving the unnecessary toner removed by the cleaning device.

In order to meet the need of downsizing an image forming machine which is equipped with such a developing apparatus as described above, a space for disposing processing means for forming an image around the photoconductor is narrowed, with the result that downsizing the developing apparatus is also strongly requested.

In specific, the developing apparatus is equipped with a developing roller adopting a magnetic brush system which conveys a dual-component-type developer composed of toner and magnetic carrier to a developing region facing the photoconductor by utilizing a magnetic force, thereby collecting the developer into a developing tank after development. Therefore, in order to stabilize development, it is necessary to replenish consumed toner and control the ratio of toner contained in a developer, that is, the concentration of toner so as to become constant.

In general, in the developing apparatus adopting the aforementioned system, that is, the magnetic brush developing system, the ratio of carrier to a developer is larger than that of the toner and accordingly the developing tank for containing the developer becomes large, whereby the developing apparatus is likely to become large as a whole. In addition, it is necessary to provide an agitating member for making a charging amount of the toner in the developer constant as well as to control the concentration of the toner. In such system, two or more agitating members are provided, which has been a bottleneck for downsizing the developing apparatus.

In response to this, such a developing apparatus is proposed and practically used that conducts development with the use of a one-component-type developer, that is, toner which is a one-component-type developer without carrier. According to such a developing apparatus that uses one-component toner, it is not necessary to control the concentration of toner, it is possible to reduce the size of the developing tank to a considerable degree owing to the inexistence of carrier, and hence it is possible to downsize the developing apparatus. In addition to this, the developing apparatus is excellent in simplicity of maintenance and so on. In short, since there is no need to replace a developer degraded, specifically due to the degradation of carrier, maintenance for the replacement is eliminated.

Further, it is required only to replenish toner, there is no need to detect the concentration of toner, and control for the detection is not required, with the result that control of the developing apparatus is simplified. In specific, as for the developing apparatus using the one-component-type toner, it is required only to replenish toner when necessary.

For instance, as shown in FIG. 1, a developing apparatus 4 is placed so as to face a photoconductor 1 serving as an image bearing member, the developing apparatus 4 visualizing an electrostatic latent image formed on the photoconductor 1. In the developing apparatus 4, a developing roller 41 is disposed in a rotatable manner so as to specifically face an opening portion of a developing tank 40 which contains toner serving as a one-component-type developer. The developing roller 41 is partially exposed to the opening portion of the developing tank 40, and is positioned so as to come into contact with the photoconductor 1, for example. This contact region forms a developing region.

The developing roller 41 carries the one-component toner on the surface thereof and conveys it to the developing region which faces the photoconductor 1. After development, the developing roller conveys and collects toner which was not used for the development into the developing tank 40. In order to once remove the collected toner from the surface of the developing roller 41, a supplying roller 42 is disposed so as to be pressed to the developing roller 41, whereby the toner carried on the surface of the developing roller 41 is scraped off. Then, toner is newly supplied onto the surface of the developing roller 41 by this supplying roller 5.

The one-component toner is supplied by the supplying roller 42 and absorbed onto the surface of the developing roller 41. In order to regulate the absorption amount, a regulating member 43 which is pressed to the surface of the developing roller 41 is disposed. Toner which has passed by the regulating member 43, the amount thereof being regulated to be constant, reaches the developing region which faces and comes into contact with the photoconductor 1 as mentioned above, and selectively adheres in accordance with the electrostatic latent image formed on the surface of the photoconductor 1, whereby development is conducted.

Further, for the purpose of achieving satisfactory development, a developing bias voltage (Va) is supplied to the developing roller 41 in general. This developing bias voltage is set to a voltage value such that the toner adheres to the electrostatic latent image while the toner does not adhere to a background region (a background portion excluding an image) of the photoconductor.

Also in order to charge the one-component toner absorbed to the developing roller with a predetermined polarity and add a predetermined amount of potential thereto, the regulating member 43 which is pressed in the aforementioned manner is disposed on the downstream side in the rotation direction of the developing roller 41, supplying to the regulating member 43 a regulating voltage (Vb) for charging the one-component toner with the predetermined polarity. Thus, as a result of passing by the regulating member, the one-component toner which is kept in a constant amount is conveyed to the developing region while being charged to be at a predetermined potential or higher.

With the above configuration, the one-component-type developer, namely, the toner is attracted onto the developing roller and conveyed to the developing region, whereby the toner adheres onto the electrostatic latent image on the photoconductor. Accordingly, it is realized to prevent the toner from adhering to the background excluding the latent image to conduct satisfactory development.

The developing apparatus of the above configuration makes the developing roller 41 into contact with the photoconductor 1 to conduct development, so that the setting of a resistance value of the developing roller 41 is an important factor for determining development characteristics. In response to this, hitherto a variety of techniques have been proposed. For instance, it is aimed to conduct development in a preferable manner by using a developing roller of high resistance.

However, even when a developing roller of high resistance is used, the variance of resistance value with temperature and humidity is large and development characteristics widely vary due to the variation of resistance value, so that a problem of large variation in image density occurs. In addition, a development ghost is likely to be formed due to electrical charges accumulated on the surface of a high resistance layer of the developing roller is likely to be formed.

In order to solve these problems are implemented a variety of development-assisting means, however, such means lead to an increase in total cost.

Further, there is also proposed an idea of solving the aforementioned problems by using a developing roller of low resistance. However, according to this method, an electrical breakdown of a toner layer and an overcurrent are likely to occur because of using the developing roller of low-resistance, and therefore it is difficult to apply this idea to a practical use as it is. Then, Japanese Unexamined Patent Publication JP-A-2-93671(1990) and Japanese Unexamined Patent Publication JP-A 3-87759(1991) propose a method of stabilizing development characteristics by connecting a protection resistor which is a high resistor of 1 MΩ–100 MΩ to the development roller of low resistance.

As mentioned above, recently, downsizing of copying machines and printers is required with the trend toward faster operations thereof, and therefore a technique for ensuring a developing performance in the developing region of the developing apparatus is desired as well as downsizing of the developing apparatus itself.

That is to say, in order to meet the faster image forming apparatuses, an idea for efficiently conveying a developer in the developing apparatus is made, and in order to also downsize the developing apparatus so as to meet downsizing of the image forming apparatuses, a developing apparatus using one-component toner is required.

In such a developing apparatus using one-component toner, developing characteristics are kept constant by stabilizing the resistance value of the developing roller, whereby excellent development is realized. The developing roller is made to be of low-resistance, to which a high resistance device is connected, however, such procedure is still insufficient.

In other words, due to a problem concerning the one-component toner itself, an overcurrent occurs when the one-component toner comes into contact with the photoconductor. In short, it is not sufficient to merely supply a predetermined voltage to the regulating member 43 for forming uniformly charged toner onto the developing roller in a uniform layer-thickness, and therefore, a considerable voltage is supplied to the supplying roller 42 which supplies toner to the developing roller 41. For this reason, in the case where the developing roller 41 of low resistance is used, an electrical breakdown of a toner layer and an overcurrent occur with the result that a preferable developing characteristic cannot be obtained.

The occurrence of overcurrent can be prevented by setting the internal resistance of toner itself to be high. However, an external additive is added to the toner in order to avoid various problems such as fluidization. Therefore, the surface resistance and contact resistance of the toner often become material factors owing to the influence of the external additive, so that it is impossible in fact to set the resistance value of the toner which is in the form of a thin layer at a high level or to keep it at a constant value or more only by controlling the internal resistance value of the toner.

SUMMARY OF THE INVENTION

In view of the problems as mentioned above, an object of the invention is, in a developing apparatus using one-component toner, to enhance safety against an electrical breakdown of a toner layer and an overcurrent which occur at the time of using a developing roller of low resistance so as to make it possible to form a stable toner layer, and to stabilize a developing characteristic.

In specific, an object of the invention is, by precisely restricting and controlling the electrical characteristics of toner and each member, to prevent an electrical breakdown of a toner layer and an occurrence of overcurrent even when a developing roller of low resistance is used, thereby providing a developing apparatus which can perform development in a preferable manner.

Another object of the invention is to achieve satisfactory development, to obtain a high quality image, and to cancel development ghosts and the like.

A developing apparatus using one-component toner for accomplishing the above-mentioned objects according to the invention, comprises:

a developing roller for carrying and conveying one-component toner to a developing region facing an electrostatic latent image bearing member; and a regulating member for regulating at least an amount of the one-component toner carried on the developing roller, wherein the developing roller is formed by covering a conductive shaft with an elastic semiconductive layer, and resistance Rd of the developing roller is defined as follows:

$$Rd=\rho d\cdot(Dd1/S1),$$

and $$10^4<Rd<5\times10^6$$

wherein S1 ($cm^2$) is an area of the developing roller which comes into contact with the electrostatic latent image bearing member via a toner layer formed on a surface of the developing roller after the developing roller passes by the regulating member, Dd1 (cm) is a layer thickness of the semiconductive layer, and ρd (Ω·cm) is a volume resistivity of the semiconductive layer, and resistance Rt (Ω) of the toner layer formed on the developing roller is set as follows:

$$Rt>5\times10^7.$$

The resistance Rt of the toner layer is determined by internal resistance Ri of the one-component toner, contact resistance Rc among toner particles and surface resistance Rs, and defined as:

$$1/Rt=1/Rs+1/(Rc+Ri)$$

In this manner, by minimizing the resistance value of the developing roller, specifically the resistance value of the semiconductive layer, it becomes possible to realize excellent development without degrading quality of image. In specific, the resistance of the toner layer is set to be equal to or more than a predetermined one, whereby an overcurrent is prevented, nonuniformity in the toner layer is prevented at the position of the regulating member, and excellent development is realized with an overcurrent suppressed.

In the developing apparatus of the above configuration, a layer thickness of the toner layer formed on the surface of the developing roller by the regulating member is set within a range of 10–30 μm, so that an electrical breakdown of the toner layer can be avoided and an overcurrent can be thereby prevented. Accordingly, it is possible to eliminate a factor of degrading quality of image due to a development failure.

Further, in the developing apparatus of the above-shown configuration, the semiconductive layer of the developing roller is made of a urethane resin having a moisture absorptivity of 1% or less, so that the variance of resistance value associated with the variance of temperature and humidity can be limited, the electrostatic latent image bearing member is prevented from being contaminated, and hence it is possible to effectively prevent quality of image from being degraded.

As described above, according to the developing roller used in the invention, it is possible to set a resistance value thereof to be low, so that it is possible by repeatedly conducting development to limit the rise of a potential due to accumulated electric charge or the like on the surface of the developing roller. In other words, at the time of development, electric charge is removed on the surface of the developing roller via a rotation axis. Therefore, it is also possible to solve a problem of a development ghost and the like caused by the rise of a potential.

Now, as for the developing roller, in order to supply toner and keep the layer thickness of toner to be constant, a variety of members are disposed, for example, the regulating member, a supplying member for supplying toner, a charge removing member for separating toner from the developing roller after development. By setting the resistance values of these contact members at a predetermined value or less, it is possible to prevent a development ghost and prevent nonuniformity of toner, so that stable development is realized.

For the purpose of achieving the object of the invention of preventing an overcurrent, the developing apparatus comprises:

a charge removing member with which the developing roller comes into contact after development, for removing charges of toner remaining on the developing roller, wherein a protection resistor for preventing an overcurrent is electrically connected to the charge removing member.

Further, the developing apparatus comprises:

a supplying member for removing the toner remaining on the developing roller after development and newly supplying toner, wherein a protection resistor for preventing an overcurrent is electrically connected to the supplying member.

Furthermore, a protection resistor for preventing an overcurrent is electrically connected to the regulating member.

The protection resistor is thus connected to the respective members which come into contact with the developing roller, whereby an overcurrent which results in nonuniformity of a thickness of the toner layer and the like which is caused unintentionally is prevented and it thereby becomes possible to realize more stable development. In specific, it is possible to effectively prevent an overcurrent which results from a low resistance value of the developing roller.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
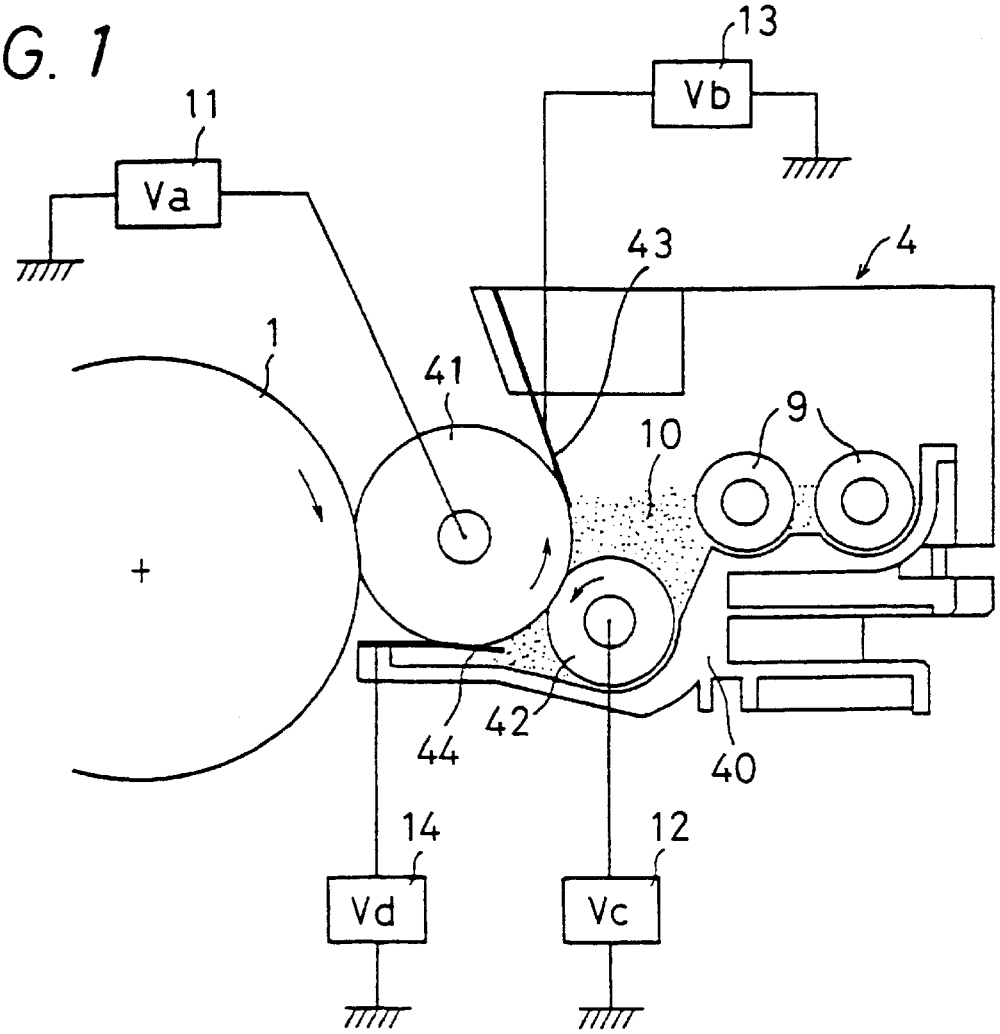
FIG. 1 is a view showing a developing apparatus 4 utilizing one-component toner according to the invention, the view showing a structure of the developing apparatus 4 which comes into contact with a photoconductor 1 bearing an electrostatic latent image and performs development.

Now referring to the drawings, preferred embodiments of the invention are described below.

Figure 2:
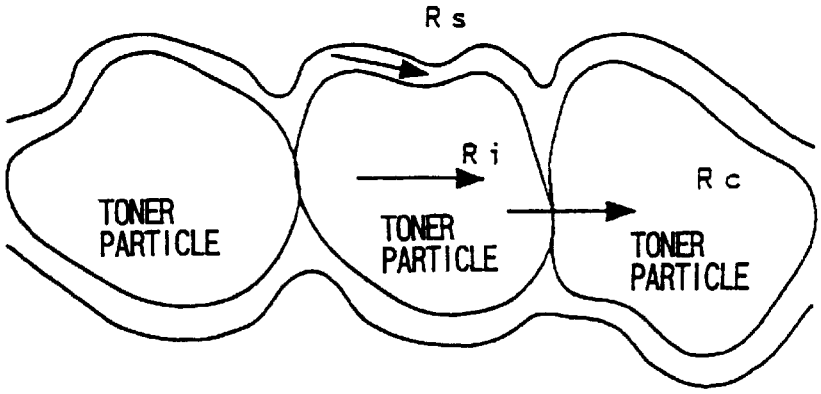
FIG. 2 is a schematic diagram for describing resistance of a toner layer by a toner layer which is formed on the surface of a developing roller 41 in the developing apparatus 4 as shown by FIG. 1.
Figure 3:
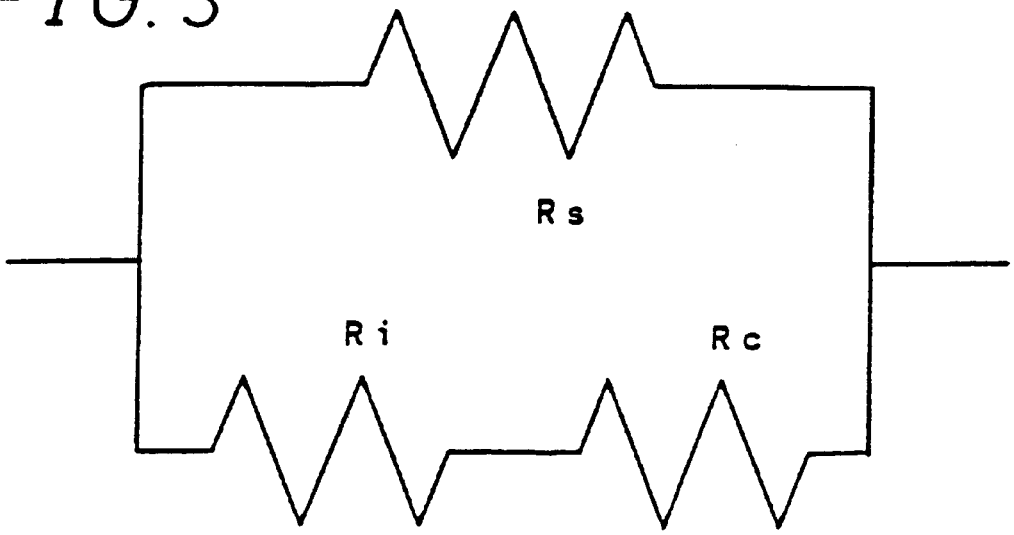
FIG. 3 shows an equivalent circuit of the resistance of a toner layer as shown by FIG. 2.
Figure 4:
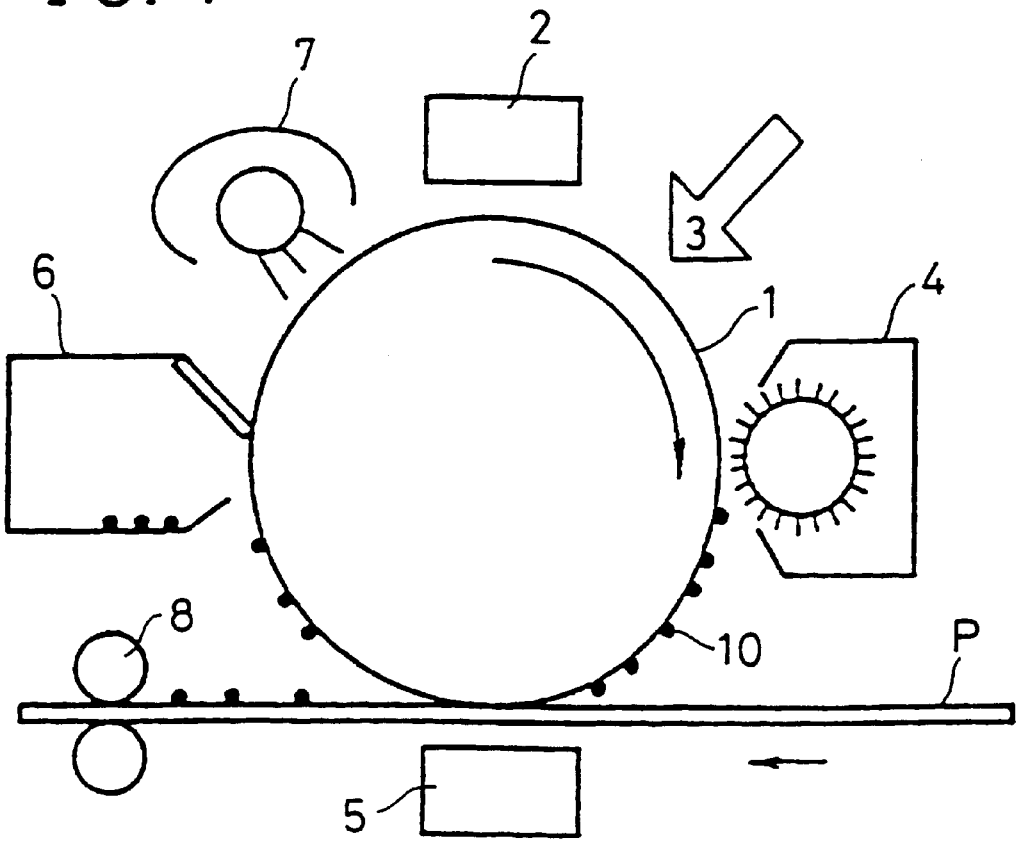
FIG. 4 is a block diagram for describing an overview of the whole structure of an image forming apparatus which is equipped with the developing apparatus 4 as shown by FIG. 1.

An embodiment of a developing apparatus according to the invention will be described with reference to FIGS. 1–4. FIG. 1 is a block diagram showing a developing apparatus 4 according to the invention, which is positioned so as to face specifically a photoconductor 1 serving as a bearing member of a latent image of an image forming apparatus. FIG. 2 is a schematic diagram for describing the relation among the internal resistance, the surface resistance and the contact resistance of one-component toner in connection with the invention. FIG. 3 shows an electrically equivalent circuit to the resistance of a toner layer shown by FIG. 2. FIG. 4 is a block diagram showing an overview of the structure of an image forming apparatus which is equipped with the developing apparatus 4 shown by FIG. 1.

At first, an overview of the structure of an image forming apparatus will be described with reference to FIG. 4. The image forming apparatus is equipped with a photoconductor 1. The photoconductor is positioned almost at the center of the main body of the image forming apparatus, composing an image bearing member for bearing an electrostatic latent image which is rotationally driven at a constant speed in the arrow direction at the operation of forming an image and is formed in the shape of a drum. A variety of means for image forming process are positioned so as to face around this photoconductor 1.

The above-mentioned means (devices) for image forming process are: a charger 2 for uniformly charging the surface of the photoconductor 1; a not-shown optical system for emitting an image 3 by light corresponding to an image; a developing apparatus 4 according to the invention for visualizing an electrostatic latent image which is formed on the surface of the photoconductor 1 when exposed by the optical system; a transfer unit 5 for transferring a developed image (an image of toner 10) onto a sheet-like paper P which is conveyed as necessary, a cleaning device 6 for removing a developer (toner) remaining on the surface of the photoconductor 1 without being transferred after transfer; and a charge removing unit 7 for removing electric charge remaining on the surface of the photoconductor 1. They are positioned in this order in the direction of rotation of the photoconductor 1.

A large number of papers P are stored in, for example, a tray or a cassette, and one of the stored papers is fed by feeding means and sent into a transfer region facing the photoconductor 1 where the transfer unit 5 is positioned so as to match the tip end of a toner image formed on the surface of the photoconductor 1. This transferred paper P is peeled off from the photoconductor 1 and sent into a fixing device 8.

The fixing device 8 fixes an unfixed toner image transferred onto the paper so as to become a permanent image, wherein a face thereof facing the toner image is a heat roller which is heated up to a temperature for melting and fixing toner, and a pressure roller which is pressurized to the heat roller and makes the paper P adhere toward the heat roller is disposed. The paper P passing through this fixing device 8 is discharged out of the image forming apparatus via a discharging roller onto a discharge tray (not shown).

In a case where the image forming apparatus is a copying machine, the optical system (not shown) irradiates an original document for copy and emits reflection light from the original document as an optical image 3. Otherwise, in the case where the image forming apparatus is a printer or a digital copying machine, the optical system emits an optical image which is obtained by ON-OFF driving a semiconductor laser in response to image data. In specific, in a digital copying machine, image data which is obtained by reading reflection light from an original document for copy by an image reading sensor (a CCD device etc.) is inputted into the optical system including the semiconductor laser, and an optical image corresponding to the image data is outputted. Further, in a printer, the reflected light is converted to an optical image corresponding to image data from another processing apparatus such as a word processor and a personal computer, and the optical image is emitted. For this conversion to an optical image, not only a semiconductor laser but also an LED device, a liquid crystal shutter or the like is utilized.

Thus, when the operation of forming an image in the image forming apparatus is started, the photoconductor 1 is rotationally driven in the arrow direction, and the surface of the photoconductor 1 is uniformly charged to a potential of specified polarity by the charger 2. After this charge, the optical image 3 is emitted by the optical system (not shown), and an electrostatic latent image corresponding to the optical image is formed on the surface of the photoconductor 1. For the purpose of visualizing this electrostatic latent image, the image is developed by the developing apparatus 4 which comes subsequently. In the invention, this development is performed using one-component toner, and the toner is selectively absorbed onto the electrostatic latent image formed on the surface of the photoconductor 1 by, for example, a force of static electricity, whereby development is performed.

The toner image thus developed on the surface of the photoconductor 1 is electrostatically transferred onto the paper P conveyed as necessary in synchronization with rotation of the photoconductor 1, by the transfer unit 5 which is positioned in the transfer region. In this transfer, the transfer unit 5 charges the rear face of the paper P at a polarity opposite to the charge polarity of the toner, whereby the toner image is transferred to the side of the paper P.

After the transfer, part of toner image which was not transferred remains on the surface of the photoconductor 1, this toner residue is removed from the surface of the photoconductor 1 by the cleaning device 6, and the surface of the photoconductor 1 is discharged to a uniform potential, for example, almost zero potential by the charge removing unit 7 in order to reutilize the photoconductor 1.

On the other hand, the transferred paper P is peeled off from the photoconductor 1 and conveyed to the fixing device 8. By this fixing device 8, the toner image on the paper P is melted, pressed and fused onto the paper P due to a pressurizing force between rollers. A paper passing through this fixing device 8 is discharged as an image formed paper P to a discharge tray or the like which is disposed outside of the image forming apparatus.

(An Embodiment of the Invention)

Next, an embodiment of the invention will be described with reference to FIGS. 1 and 2. In other words, a developing apparatus using one-component toner according to the invention will be described in detail.

At first, the structure of a developing apparatus which performs development using one-component toner will be described with reference to FIG. 1. In a developing tank 40 which contains one-component toner, for example, non-magnetic one-component toner 10, the developing apparatus 4 comprises a developing roller 41 and a supplying roller 42 for supplying the one-component toner 10 to the side of the developing roller 41 disposed so as to be rotatable, and two screw rollers 9 for sending the one-component toner 10 replenished as necessary, into the developing tank 40 are disposed on the right side of the developing tank 40 in the drawing.

The developing roller 41 disposed in the developing tank 40 is partially exposed, and disposed so as to rotate in the same direction in the developing region which faces the photoconductor 1 in the drawing, in order to convey the toner to the developing region which faces the photoconductor 1. In other words, the direction of rotation of the photoconductor 1 and the direction of rotation of the developing roller 41 are set to be opposite to each other. The above-mentioned supplying roller 42 is pressed to this developing roller 41.

As for a structure, the developing roller 41 is formed by, for example, coating the surface of a metal roller (including a rotation axis) with a polymeric elastic material. As the polymeric elastic material, polyurethane in which carbon is dispersed, ion conductive solid rubber or the like are used, whereby it is possible to maintain a predetermined resistance value which does not cause fusion of toner and so on, and they efficiently work at the time of supplying a developing bias voltage as will be mentioned later. An example of the structure of the developing roller 41 used for the invention will be described later.

A driving motor which is not shown is connected to this developing roller 41, and the developing roller 41 is rotationally driven in the arrow direction in the drawing. The one-component non-magnetic toner 10 is absorbed onto the surface of the developing roller 41 which is rotating, and conveyed to the developing region which faces the surface of the photoconductor 1. Then, since the developing roller 41 is pressed to the surface of the photoconductor 1, the pressed region becomes the developing region, and the one-component toner 10 is absorbed to an electrostatic latent image formed on the surface of the photoconductor 1, whereby development is performed. This developing region where the developing roller 41 and the photoconductor 1 come into contact with each other, that is, a contact region is set to a desired contact area S1 ($cm^2$). This contact area S1 will be also described in detail.

As the one-component toner 10, which is, for example, one-component non-magnetic toner whose average particle size is about 10 $\mu$m, polyester toner or styrene acrylic toner is used.

To this developing roller 41, a developing bias voltage Va is supplied from a developing bias power circuit 11. This developing bias voltage Va is set to a polarity and a voltage value such that the toner is made to adhere to the electrostatic latent image formed on the photoconductor 1 and the toner is not made to adhere to the other region, that is, a non-image region.

As for the rotation direction, the supplying roller 42 is rotationally driven so as to rotate in the opposite direction to the rotation direction of the developing roller 41 at a portion (pressurized region) where the developing roller faces the developing roller 41. In other words, the rotation direction of the developing roller 41 and the rotation direction of the supplying roller 42 are set to be the same with each other. For this supplying roller 42, a material which is identical to that for the developing roller 41 is used, and control of electric resistance can be also executed by a resistance control material which is identical to that for the developing roller 41. Further, a foamed material is used for the purpose of enhancing elasticity of the supplying roller 42.

A bias voltage Vc is applied from a bias power circuit 12 to the supplying roller 42, and in general, a bias voltage in the direction of pushing the toner to the side of the developing roller 41, that is, in the direction of repulsing the toner on the side of the supplying roller 42 and supplying to the developing roller 41, is set. For instance, in the case of using negative-polarity toner, a bias voltage Vc which is smaller than that applied to the developing roller 41 is applied to the supplying roller 42.

The developing roller 41 and the supplying roller 42 are connected to a driving motor which is not shown, and they are rotationally driven in the arrow direction in the drawing, whereby toner is supplied to the developing roller 41 by the supplying roller 42, and after development, toner which was not used for the development on the surface of the developing roller 41 is peeled off (removed). This toner supplied by the supplying roller 42 is deposited on the surface of the developing roller 41, and before the toner is conveyed to the developing region facing the surface of the photoconductor 1, the toner mass per unit area is regulated to a fixed thickness of toner layer by a blade 43 which is moderately pressed to the developing roller 41, the blade serving as a member for regulating the toner mass per unit area.

The blade 43 is pressed to the developing roller 41 by a moderate pressure. This blade 43 is formed by using a blade member which is made of a sheet-like metallic material, and a flat (face) portion in the vicinity of a tip end thereof is pressed to the developing roller 41. Therefore, the toner 10 supplied to the developing roller 41 is regulated to a predetermined amount of electrified charge and thickness in accordance with a predetermined set pressure and set position of the blade 43, and conveyed to the developing region facing and coming into contact with the photoconductor 1.

The blade 43 serving as a regulating member is disposed in a manner that one end thereof is fixed to the side of the developing tank 40 and a flat portion of a free end side of the other end thereof is pressed to the surface of the developing roller 41. The regulating member 43 is made of, for example, a metal sheet of phosphor bronze, stainless (SUS) or the like whose sheet thickness is about 0.1–0.2 mm, and a flat portion in the vicinity of a tip end thereof is pressed to the developing roller 41 at a predetermined pressure along the direction of the length thereof (the direction of a rotation axis of the developing roller). Accordingly, the one-component toner 10 carried on the surface of the developing roller 41 via the supplying roller 42 is regulated to a constant mass per unit area by the regulating member 43, and conveyed to the developing region coming into contact with the photoconductor 1.

Also to this blade 43, a predetermined voltage Vb is supplied from a bias power circuit 13. As for this bias voltage Vb, a value is set, which is larger in a direction of pushing the toner 10 to the side of the developing roller 41, for example, to the side of the negative polarity in the case of using negative-polarity toner. Further, the bias voltage Vb supplied to the blade 43 may be set to the same potential as the developing bias voltage Vb supplied to the developing roller 41, or to a larger value in the absolute value thereof.

On the other hand, the toner 10 which is conveyed to the developing region facing the photoconductor 1 is selectively caused to adhere in correspondence with an electrostatic latent image formed on the surface of the photoconductor 1, whereby the electrostatic latent image is developed by color of the toner. Then, the toner 10 which was not used for the development is returned into the developing tank 40 by rotation of the developing roller 41. At the position where the toner is returned, a charge removing member 44 for removing charge of toner is disposed so as to be pressed to the developing roller 41. This charge removing member 44 is positioned before the supplying roller 42 in the rotation direction of the developing roller 41, one end portion of which is fixed to the developing tank 40 so as to be moderately pressed to the developing roller 41, and a flat of the free end side of which is pressed to the developing roller 41 by utilizing the elasticity of the charge removing member 44.

After the development, charge of the toner which was not used for the development is removed by the charge removing member 44 when collected into the developing tank 40 by rotation of the developing roller 41, thereby being reused. Also to this charge removing member 44, a bias voltage Vd for removing charge of the toner is supplied from a power circuit 14.

Thus, the developing apparatus 4 conveys the toner 10 to a region facing the photoconductor 1 and visualizes a latent image formed on the surface of the photoconductor 1. As mentioned above, this toner image which is formed on the surface of the photoconductor 1 is transferred onto a paper P which is conveyed as necessary in a transfer region by action of the transfer unit 5, and then the paper is discharged outside of the image forming apparatus through the fixing device 8.

The photoconductor 1 is formed by using an OPC photoconductor or the like, which is formed by applying an underlayer onto the surface of a conductive base of metal or resin, applying a carrier generating layer (CGL) as an upper layer thereof, and applying as the outermost layer a carrier transferring layer (CTL) whose main component is polycarbonate. In the invention, the photoconductor 1 is not restricted to such a photoconductor, but may be any bearing member that bears an electrostatic latent image.

(Structure of a Developing Roller)

The developing roller 41 is as described above and the structure thereof will be described in more detail.

Figure 5:
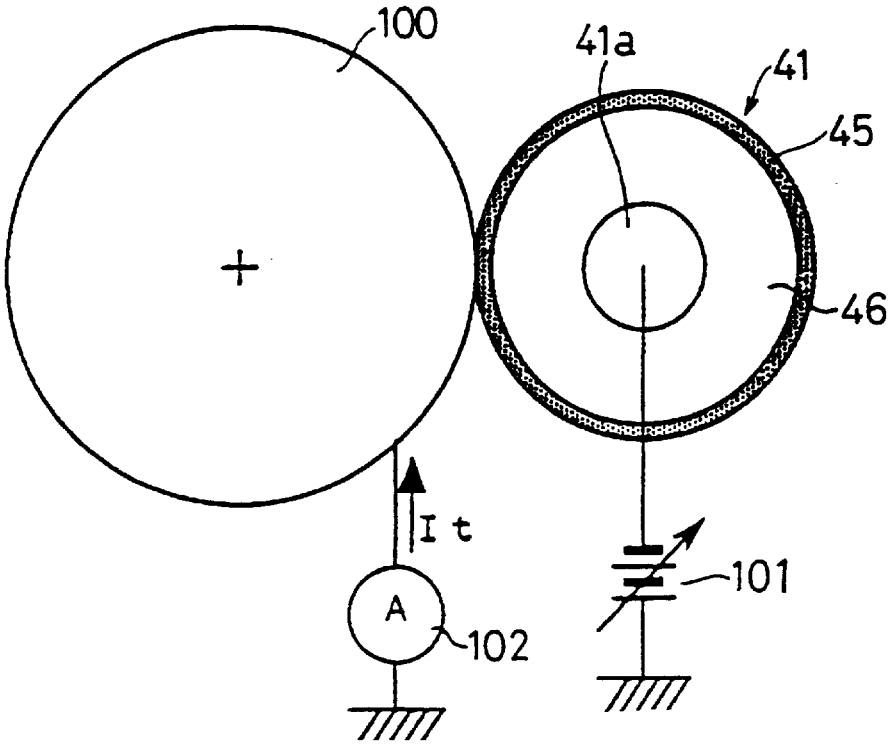
FIG. 5 is a view showing an embodiment of an apparatus for measuring the value of static resistance of toner in the status of a thin layer, the toner being used for the developing apparatus based on the invention.

The developing roller 41 is constructed by coating a core (axis 41*a*) of metal or low-resistance resin with a semiconductive layer 46 which is an elastic member whose dielectric ratio is about 10 as shown by FIG. 5, for example. On the surface of this semiconductive layer 46, a toner layer 45 is formed.

The elastic member covering the surface of the developing roller 41 is preferably formed of the following materials: a material based on a dispersion-type resistance adjusted resin in which conductive fine particles as an electrical resistance control material, for example, either or both of carbon and $TiO_2$ (titanium oxide) are mixed and dispersed in a resin selected from the group consisting of EPDM, urethane, silicone, nitrile-butadien rubber, chloroprene rubber, styrene-butadiene rubber, butadiene rubber and the like; and a material based on an electric resistance adjusting resin in which an ionic conductive material, one or more of inorganic ionic conductive materials selected from the group consisting of sodium perchlorate, calcium perchlorate, sodium chlorite and the like are added to the resin selected from the group consisting of EPDM, urethane, silicone, nitrile-butadien rubber, chloroprene rubber, styrene-butadiene rubber, butadiene rubber and the like. In the case of using a foaming agent in foaming/mixing process for obtaining elasticity of the elastic member, silicone surfactants such as polydiallylsiloxane and polysiloxane-polyalkyne oxide block copolymer are preferably used as the foaming agent.

As one example of the foam molding process, an example of a hot blow foam molding includes the steps of mixing the above-mentioned material in suitable proportions, agitating the resultant mixture by a mixer/injector, introducing the mixture into an injection-extrusion mold, heating the mixture at a temperature of between 80° C. and 120° C., and injecting the molded stock. A preferred heating time ranges from about 5 to 100 minutes.

In a case where the elastic member is integrally molded with a core bar by injection molding, an integrally molded part may be obtained by placing a conductive metal core bar (shaft) at the center of a preliminarily prepared mold, introducing the mixture into the mold similarly to the above-mentioned example, and heating and vulcanizing the mixture for a period ranging from about 10 to 160 minutes.

As carbon black, which is one of the electric resistance control materials for the developing roller 41, carbon black having a nitrogen absorption specific surface of 20 $m^2/g$ to 130 $m^2/g$ and a DBP oil absorption amount of 60 ml/g to 120ml/g (ISAF, HAF, GPF, SRF or the like) is used. The carbon black is mixed with polyurethane in a ratio of 0.5 to 15 parts by weight (about 70 parts in some instances) per 100 parts by weight of polyurethane.

Examples of the polyurethane include a soft polyurethane foam and a polyurethane elastomer. Besides, the aforesaid EPDM, urethane, silicone, nitrile-butadiene rubber, chloroprene rubber and butadiene rubber may be used.

In the case where the developing roller 41 is formed of a material based on EPDM instead of a material based on polyurethane, the EPDM which contains ethylene, propylene and a third component such as dicyclopentadiene, ethylidene norbornene, 1,4-hexadiene is preferably formed by mixing ethylene, propylene and a third component in proportions of 5 to 95 parts by weight, 5 to 95 parts by weight, and 0 to 50 parts by weight based on iodine value, respectively. In addition, to achieve a satisfactory dispersibility, a suitable amount of a carbon black to be mixed is 1 to 30 parts by weight per 100 parts of EPDM. As described in the foregoing, examples of usable carbon black include ISAF, HAF, GPF, SRF and the like.

In combination with carbon black or a resistance control material, as a resistance adjusting base material, ionic conductive materials such as sodium perchlorate, tetraethylammonium chloride, or surfactants such as dimethyl polysiloxane, polyoxyethylene lauryl ether may be used in a ratio of 0.1 to 10 parts by weight per 100 parts by weight of EPDM for further improving the dispersivity and homogeneity.

Examples of the above ionic conductive materials include inorganic ionic conductive materials such as sodium perchlorate, calcium perchlorate, sodium chloride, and organic ionic conductive materials such as modified aliphatic acid dimethylammonium ethosulfate, stearylammonium acetate, laurylammonium acetate, octadecyl trimethylammonium perchlorate and the like. Such materials may be used alone or in combination of plural materials.

(Structure of a Blade which Serves as a Member for Regulating a Toner Layer Thickness)

As shown in FIG. 1, the one end of the blade 43 is fixed to the developing tank 40 at a predetermined length, and the free end side thereof which is not fixed is pressed to the developing roller 41 at a moderate pressure. In specific, the blade 43 is fixed to the developing tank 40 at the one end portion so as to be pressed to the developing roller 41 by utilizing an elasticity of the blade itself, for example.

The blade 43, which is a metal sheet having a sheet thickness of about 0.05–0.5 mm, contacts the developing roller 41 at a predetermined pressure by an elasticity of a material thereof, that is, by elastic deformation, and regulates the thickness of a toner layer and the amount of electrified charge to predetermined ones. For instance, the tip end of the blade 43 which contacts the developing roller 41 has a face which is tilted with a minute amount in a direction where an open angle formed by the developing roller and the blade 43 is opened, the blade 43 being bent in a direction away from the surface of the developing roller 41 in a bending process or the like. Besides, a coating process or the like may be applied to a portion of the blade 43 which contacts the developing roller 41, for the purpose of controlling the charge amount of toner and suppressing toner fusion.

In general, a material which has an elasticity is used as a material for forming the blade 43. For instance, it is possible to use spring steel such as SUS, stainless steel such as SUS301, SUS304, SUS420J2, SUS631, and an alloy of copper such as C1700, C1720, C5210, C7701.

Other than a process of mechanical cutting, grinding and bending, the minute tilted face of the free end of the blade 43 is manufactured by a processing method such as: a chip-like tip end which is previously formed into a desired shape in a molding process is placed with a conductive adhesive; and a difference process is applied to the tip end of the blade and a metal foil is placed thereon with a conductive adhesive.

The blade 43 is used basically in a manner of making the above-mentioned base as it is into contact with the developing roller 41. However, for the purpose of stabilizing the charge amount of toner and suppressing toner deposition onto the surface of the blade, a face which contacts the developing roller may be coated. As the coating material, the following ones are used: a material having a film thickness of 8–12 $\mu$m, which is made by spray-coating a fluorine containing resin or a graphite containing resin onto the surface of the blade, drying at about 80° C. for 30 or more minutes to burn at 260° C. for 30 minutes, and lightly grinding with a #10000 paper file; and a material which is made by applying an oxidizing process to aluminum formed on the surface of the blade and forming an almite film having a thickness of about 50–100 $\mu$m a surface thereof.

(Structure of a Charge Removing Member)

In FIG. 1, the charge removing member 44 directly comes into contact with and removes the charge of toner after development in the state of being pressed to the developing roller 41 and peels off the toner from the developing roller 41, thereby reusing it. Other than such a charge removing method, there is a method of removing charge by a corona discharging unit, or disposing a contact peel-off rotating member to peel off the toner from the developing roller 41, thereby reusing it.

In the charge removing member 44 as shown in FIG. 1, a sheet-like elastic member is used and pressed to the developing roller 41 at a moderate pressure in the same manner as the blade 43, and the bias voltage Vd is supplied thereto from the power circuit 14 so as to remove the charge of the collected toner after development. Therefore, as a material which is used for an elastic member, nylon, PET (polyethylene terephthalate), a PTFE (polytetrafluoroethylene) containing resin, polyurethane or the like is used. This material is used as a base material (main component), and made to have proper electric resistance by using an electric resistance control material such as carbon. To such a charge removing member 44 having resistance, the charge removing voltage Vd is supplied from the power supply 14.

For the carbon black used as an electrical resistance control material, carbon blacks having a nitrogen absorption specific surface area within the range from 20 $m^2/g$ to 130 $m^2/g$, for example furnace blacks or channel blacks such as ISAF, HAF, GPF and SRF are used. A mixing ratio of the carbon black is equal to or more than 10 parts by weight (in some cases, equal to or less than 70 parts by weight) per 100 parts by weight of polyurethane (ditto for nylon, PET and other resins).

(One-component Toner)

The toner 10 which is a non-magnetic one-component developer is prepared by mixing 80–90 parts by weight of styrene-acryl copolymer, 5–10 parts by weight of carbon black and 0–5 parts by weight of a charge control agent, and pulverizing the resultant mixture, thereafter classification is executed so as to obtain negative-charge toner particles having a mean particle size of about 5 to 10 $\mu$m. In order to improve fluidity, 0.5 to 1.5 parts by weight of silica ($SiO_2$) is mixed with the toner particles or the toner particles are coated with silica. Thus non-magnetic one-component toner 10 is obtained.

The toner 10 is not limited to the negative-charge type but also positive-charge toner may be used. The positive-charge toner may readily be prepared by suitably selecting a binder resin which is a main component, a charge control agent and the like. Such toner 10 is not only applicable to the black toner for use in monochromatic copying machines and printers but also to color toner for use in color copiers and printers.

The non-magnetic one-component toner 10 is not limited to the one having above-mentioned composition but toners having compositions which will described below are applicable to the developing apparatus of the invention.

As a binder resin which is a main component, thermosetting resins, such as polystyrene, polyethylene, polyester, low molecular weight polypropyrene, epoxy resins, polyamide, and polyvinyl butyral besides styrene-acryl copolymer may be used.

As a colorant for use in black toner, besides the aforesaid carbon black, furnace black, nigrosine dyes, metal-containing dyes and the like may be used. As colorants for use in color toner, yellow colorants such as benzidine-based yellow pigments, phonon yellow, insoluble acetoacetanilide-based azo pigments, monoazo pigments, azomethine pigments; magenta colorants such as xanthene-based magenta dyes, tungsten molybdate lake pigments, anthraquinone dyes, coloring materials including xanthene dyes and organic carboxylates, thioindigo, insoluble naphthol-based azo pigments; and cyan colorants such as copper phthalocyanine-based pigments may be used.

Further, as a fluidizing agent for toner, besides silica which is applied as a coating agent, colloidal silica, titanium oxide, alumina, zinc stearate, polyvinylidene fluoride and a mixture thereof may be used.

Still further, as a charge control agent for negative-charge toner, azo-containing dyes, organometallic complexes, chlorinated paraffin and the like may be used. As a charge control agent for positive-charge toner, on the contrary, nigrosine dyes, metallic salts of aliphatic acids, amine, quarternary ammonium salts and the like may be used.

In the developing apparatus 4 using the one-component toner 10 as described above, the toner mass per unit area of the toner 10 is regulated to a constant layer thickness by the blade 43 which is pressed to the developing roller 41. After that, the toner 10 is conveyed to the developing region, and an electrostatic latent image formed on the photoconductor 1 is developed. At this time, the bias voltages Va, Vc and Vb are supplied to the developing roller 41, the supplying roller 42 and the blade 43, respectively. Therefore, an electrical breakdown of toner and an overcurrent occur, so that the development characteristic may become unstable.

With reference to this point, in the invention, in the case where an area in which the photoconductor 1 and the developing roller 41 come into contact with each other is denoted by S1 ($cm^2$), the layer thickness of the semiconductive layer of the developing roller 41 is denoted by Dd1 (cm) and the volume resistivity of the developing roller 41 is denoted by ρd (Ω·cm), resistance Rd of the developing roller 41 is defined as Rd=ρd·(Dd1/S1), and the resistance value of the resistance Rd is limited to a range which satisfies $10^4 < Rd < 5\times10^6$. In the case where resistance of the toner layer 45 formed on the developing roller 41 in the status of a thin layer is denoted by Rt (Ω), a resistance value thereof is limited to a range which satisfies $Rt > 5\times10^7$. The value of the resistance Rt of the toner layer is determined by, as shown in FIG. 2, internal resistance Ri of the toner 10 itself, surface resistance Rs of the toner 10 and contact resistance Rc among toner particles.

The resistance value of the resistance Rt of the toner layer which is determined by the respective resistances Rs, Ri, Rc as shown in FIG. 2 can be expressed by an equivalent circuit shown by FIG. 3. Accordingly, the resistance value of the resistance Rt of the toner layer can be given by expression (1) as shown below:

$$1/Rt = 1/Rs + 1/(Rc + Ri) \quad (1)$$

As shown in FIG. 2, a toner layer which is uniformly formed on the surface of the developing roller 41 is a row of the respective particles of the toner 10. The internal resistance Ri of the toner is determined by selection of the aforementioned main resin, the amount of carbon black to be internally added and so on. The surface resistance Rs of the toner varies in accordance with the kind and the amount of a charge control agent for controlling a charge characteristic and an external additive such as silica for enhancing fluidity. The contact resistance Rc among toner particles varies mainly in accordance with filling factor and pressure. These resistance values are likely to be affected by temperature and humidity, and may vary extremely.

Previously, it is general that the volume resistivity of toner is volume resistivity ρi of the inner part of toner. As a method for measuring this volume resistivity ρi, in the case of crushed toner, the following is common: a method of measuring a mass before crushed; and a method of pressure aggregating toner and measuring a mass after heated and melted at a temperature of about 200° C. However, it has been found in the course of a variety of experiments using toner that there is little correlation between the magnitude of volume resistivity of toner found by such methods and occurrence of an overcurrent in the developing apparatus 4 using the low-resistance developing roller 41. With respect to the resistance value of resistance Rt of an actual toner layer which is given by the expression (1), the surface resistance Rs and the contact resistance Rc are often dominant.

Accordingly, in the developing apparatus according to the invention, the value of resistance Rt of a toner layer formed on the surface of the developing roller 41 in the status of a thin layer is measured and toner to be used is restricted, which is one of the methods for preventing an overcurrent. It is very difficult to individually measure and control the resistance values of the respective resistances Rs, Rc, Ri. Therefore, a simple method for measuring a value which is close to the resistance value of resistance Rt of an actual toner layer will be shown afterwards.

FIG. 5 is a view for describing a method for measuring the resistance value of resistance Rt of the toner layer 45 formed on the developing roller 41 in the status of a thin layer. In the drawing, the toner layer 45 of the toner 10 is uniformly formed on the surface of the developing roller 41 whose structure matches actual development conditions, and thereafter the developing roller is made into contact with an aluminum tube 100 instead of the photoconductor 1 at a pressure which is equal to one used in practical use. In a standstill of the respective members, the same developing bias voltage V1 is supplied from a voltage source 101 to the conductive rotation axis 41*a* of the developing roller 41. Then, a current It which flows via the toner layer 45 is precisely measured by a microammeter 102. Thus, a static resistance value which is the resistance Rt of the toner layer 45 is measured.

In this case, by measuring the current It in a standstill of the respective members, it is possible to measure a precise current amount, excluding a noise factor such as a toner charge current and a toner transfer current which occur in operation.

The resistance value of static resistance Rt (Ω) of the toner layer 45 is given by expression (2) as shown below:

$$Rt = V1/It \quad (2)$$

wherein V1 (V) is a supplied voltage from the voltage source 101 and It (A) is a current measured by the microammeter 102.

In this case, the static resistivity pt (Q·cm) of the toner layer 45 is given by expression (3) as shown below:

$$\rho t = Rt\cdot(w\cdot l/Dt1) \quad (3)$$

wherein l (cm) is an effective length of the aluminum tube 102, w (cm) is a contact nip width and Dt1 (cm) is a thickness of the toner layer 45.

The resistance value of resistance Rt (Ω) of the toner layer 45 is given by expression (4) as shown below using the static resistivity pt of the toner layer 45:

$$Rt = \rho t\cdot(Dt1/S1) \quad (4)$$

wherein S1 ($cm^2$) is an area which comes into contact with a photoconductor.

The resistance value of resistance Rd (Ω) of the developing roller 41 is given by expression (5) as shown below:

$$Rd = \rho d\cdot(Dd1/S1) \quad (5)$$

wherein Dd1 (cm) is a layer thickness of the semiconductive layer 46 and ρd (Ω·cm) is a volume resistivity thereof.

An electric field strength Et (MV/m) which is applied to the toner layer 45 is given by expression (6) as shown below:

$$Et = Vt/Dt2 \quad (6)$$

wherein Vt is a bias which is applied to the toner layer 45 and Dt2 (μm) is a layer thickness of the toner layer 45.

The value of resistance Rd (=ρd·(Dd1/S1)) of the developing roller 41 used in the developing apparatus according to the invention is set within a range which is over $10^4$ and less than $5\times10^6$, as described above. Since the lower limit value of a resistance value of resistance Rt of the toner layer is $5\times10^7$, there is no problem for practical use to ignore a voltage drop in the semiconductive layer 46 of the developing roller 41 of a measurement system as shown in FIG. 5.

Figure 6:
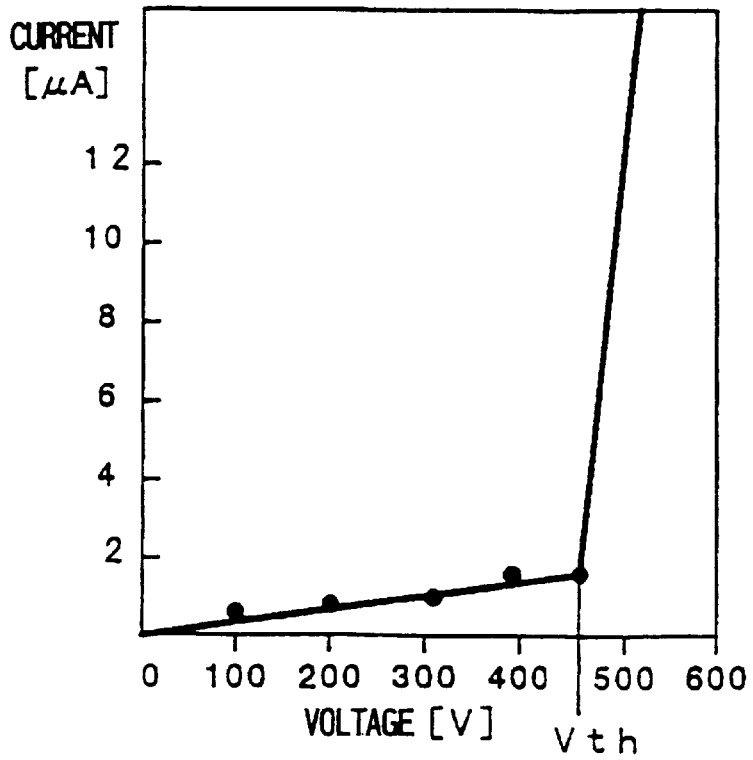
FIG. 6 is a graph showing a volt-ampere characteristic which is an example of results of measuring the value of static resistance of toner in the status of a thin layer, the toner being used for the developing apparatus based on the invention.

The result of measuring the static resistance value (Rt) of the toner layer 45 by the method as shown above, that is, the method shown by FIG. 5 and plotting a volt-ampere characteristic of the toner layer 45 will be shown in FIG. 6. It appears that the current of the toner layer which is measured indicates a relatively linear characteristic in the low voltage part and an overcurrent flows suddenly when reaching a certain value Vth (V). This voltage value Vth is a discharge starting voltage at which aerial discharge or surface discharge occur among toner particles.

Thus, the volt-ampere characteristic is relatively linear in a range of voltage up to the discharge starting voltage, so that a resistance value given by the expression (2) on the basis of a current value measured at a voltage in this range is defined as the static resistance value Rt of the toner layer.

In the developing apparatus 4 according to the invention, in order to stabilize the layer thickness of the toner layer and the amount of charge, a bias voltage is supplied to a variety of members which are placed and made into contact around the developing roller 41. Therefore, it becomes a compulsory requirement to set so that discharge does not occur at a bias voltage supplied to the toner layer 45.

Even when a voltage supplied to the toner layer 45 is within the discharge starting voltage of the toner layer, a nonuniform voltage drop of the developing roller 41 occurs due to a nonuniform current in the case where much current flows in the toner layer, because the resistance value of the toner layer in the status of a thin layer is nonuniform to some extent. Accordingly, a bias voltage supplied to the toner layer becomes nonuniform, with the result that the thickness of the toner layer and the amount of charge become nonuniform and quality of image is degraded.

Therefore, in the invention, the resistance value of the toner layer is set to a value which is larger to some extent with respect to the resistance value of the developing roller 41, whereby an influence of a voltage drop occurring when a bias voltage is applied is minimized. Thus, the charge amount of toner can be uniformed, whereby development is stabilized.

Examples are shown in the following, in which stability is confirmed in development performed by the developing apparatus according to the embodiment of the invention.

EXAMPLE 1

With reference to five kinds of toner as one-component toner, results of measuring volume resistivity ρi inside of the toner, the resistance value of static resistance Rt of a toner layer of a development nip portion and the discharge starting voltage Vt are shown in Table 1. As the ammeter 102 as shown in FIG. 5, R6871 manufactured by Advantest and 677A manufactured by TREK were used.

TABLE 1

| Name of toner | ρi [$\times 10^{10}$ Ω · cm] | Rt [MΩ] | Vth [V] |
|---|---|---|---|
| RV | 15.7 | 313 | 480 |
| BN | 16.0 | 300 | 480 |
| L | 12.0 | 8 | — |
| TW | 4.2 | 52 | 400 |
| KO | 8.6 | 320 | 450 |
| K25 | 8.6 | 277 | 450 |

For the toner L as shown in Table 1, a minute amount of metal oxide is used as an external additive. Therefore, in spite of high volume resistivity ρi inside of the toner, the resistance value of resistance Rt of a toner layer itself is low. Thus, since the resistance value of a toner layer varies depending on an externally adding process of toner, it is understandable that there is no correlation between the volume resistivity ρi inside of toner and the value of resistance Rt of a toner layer. Accordingly, in the developing apparatus according to the invention using the developing roller 41 of low resistance, in order to solve the aforementioned problems such as an overcurrent of a toner layer, it is important to regulate the resistance value Rt of a toner layer based on the above-mentioned measurement methods.

The results of actually conducting development by use of the respective toners as shown in Table 1 will be described below.

As the photoconductor 1 used in the image forming apparatus as shown by FIG. 4, a negatively charged conductor is used, a conductive base of which has a diameter of 65 mm and which is charged to a potential of −550 V by the charger 2. The photoconductor 1, whose base is grounded, is rotated in the arrow direction at a peripheral speed of 190 mm/sec.

The developing roller 41 is constructed by covering the surface of the rotation axis 41*a* made of stainless whose diameter is 18 mm, with the semiconductive elastic layer 46 whose thickness is 8 mm. So that the value of average resistance (Rd) of the developing roller 41 is between $10^4$ and $5\times10^6$ (Ω), the resistance control base as described above is used. The developing roller 41 has a rubber hardness of 65–70 degrees in Asker C hardness in conformance with SRIS (The Society of Rubber Industry, Japan Standard) and has a surface roughness or 2–8 μm at 10 point mean roughness Rz in conformance with JISB0601. As shown in FIG. 1, this developing roller 41 is rotationally driven in the arrow direction at a peripheral speed of 285 mm/sec. In addition, a voltage of −400 V is supplied as a developing bias voltage Va from the power circuit 11 to the stainless rotation axis 41*a* of the developing roller 41, whereby the developing roller 41 is pressed to the photoconductor 1 via a toner layer formed on the surface of the developing roller 41 so as to make a development nip width 1.5 mm.

The supplying roller 42 is constructed by covering the surface of a rotation axis made of stainless, with conductive urethane foam whose volume resistivity is $10^5$ (Ω·cm) and cell density is 80–100 cells/inch. The supplying roller 42, whose diameter is 20 mm, is made into contact with the developing roller 41 at a contact depth of 0.5 mm. Then, the supplying roller 42 is rotationally driven in the arrow direction at a peripheral speed of 170 mm/sec. To the stainless rotation axis of this supplying roller 42, a voltage of −550 V is supplied as a bias voltage Vc by the power circuit 12.

The blade 43 which serves as a regulation member is constructed by using a stainless sheet whose sheet thickness is about 0.1 mm, and is pressed to the developing roller 41. In specific, the blade 43 has a cantilever leaf spring structure, and a free end thereof is made into contact with the developing roller 41 to be elastically deformed, whereby a predetermined pressure is applied to a toner layer formed on the surface of the developing roller 41. Also to this blade 43, a voltage of −500 V is supplied as a bias voltage (Vb) from the power circuit 13.

The charge removing member 44, which is a sheet-like elastic member made by dispersing carbon in a resin base, is constructed so that a face thereof comes into contact with the developing roller 41 at a predetermined pressure. Also to this charge removing member 44, a voltage of −350 V is supplied as a charge removing bias voltage (Vd) by the power circuit 14.

In the developing apparatus thus constructed, a uniform toner thin layer 45 was formed on the surface of the developing roller 41, and contact reversal development was conducted with respect to the photoconductor 1 as mentioned before. At this time, the toner mass per unit area m/a was set between 0.8 and 1.0 mg/cm$^2$, the toner charge amount q/m was set between −10 and −20 $\mu$C/g, and the toner layer thickness Dt was set between 10 and 30 $\mu$m.

At first, according to the result of the development by use of the one-component toner L having a toner name of L as shown in Table 1, the quality of image was terribly bad. In specific, the density was nonuniform, and fogging or the like occurred much.

In this case, it was observed that after passing by the blade 43 of a pre-development step, the toner layer was turned to be nonuniform. When development was actually conducted, the quality of image with much density nonuniformity was obtained. Besides, when the potential difference between the blade 43 and the developing roller 41 was raised from 100 V to 150 V, the toner layer after passing by the blade 43 was disturbed more intensely.

Thus, since the resistance value (Rt) of a toner layer is low in the toner L, much current flows, nonuniformity of a bias voltage supplied to the toner layer is promoted under the influence of a voltage drop of the developing roller 41, and the thickness of the toner layer 45 becomes nonuniform, whereby quality of image is degraded.

On the other hand, as a result of executing an identical developing experiment by use of the toner TW as shown in Table 1 having a low resistance value (Rt) of a toner layer while a higher value than the toner L, the toner layer was little disturbed and density nonuniformity after development was within an acceptable range. As for the other toners RV, BN, KO and K25 having higher resistance values (Rt) of a toner layer than the toner TW, the same developing experiment was executed, with the result that disturbance in the toner layer was not observed and quality of image after development was also excellent.

However, as observed when the toner L is used, nonuniformity of a toner layer is generated in toner having a low resistance value (Rt) of a toner layer, with the result that quality of image is degraded. In this case, it was preferable that the value of static resistance Rt of a toner layer was over 50 MΩ. If toners having values of static resistance Rt equal to or more than 100 MΩ had been used from among those shown in Table 1, degradation of quality of image were not observed as mentioned above and more excellent quality of image could have been obtained.

Accordingly, in the invention, it is possible to prevent an overcurrent from occurring and conduct stable development by using toner which shows such a characteristic that the resistance value of resistance Rt of a toner layer is equal to or more than $5\times10^7$ (Ω). It can be said that the resistance Rt of a toner layer is preferably equal to or more than 100 MΩ.

However, in the case where the resistance value of the developing roller 41 has a resistance value of $10^4$ (Ω) or less, when the toner TW having a resistance Rt of a toner layer close to 50 MΩ of a lower limit value thereof was used, disturbance was caused in the toner layer probably due to an overcurrent, with the result that quality of image was degraded. Therefore, in the case of using the toner TW, it is possible to conduct development in an excellent manner by choosing a developing roller 41 whose resistance value (Rd) is over $10^4$ (Ω).

With regard to the resistance (Rd) of the developing roller 41 used for the developing apparatus according to the invention, the lower limit value thereof is $10^4$ (Ω) as mentioned before. Next, the upper limit value will be described below including the lower limit value. In specific, in the example, the resistance value Rt of a toner layer has been described above. It is as mentioned before that the resistance value of the developing roller 41 is important even in a range which regulates such a resistance value Rt of the toner layer.

Previously, in the case where an electrical characteristic of the developing roller 41 is argued, it is often argued on the basis of volume resistivity. However, when using the developing roller 41 which has low resistance like the invention for the purpose of realizing excellent development, it is necessary to more precisely control the resistance value at a contact portion in which the developing roller comes into contact with the respective members. By regulating the resistance value, it is possible to realize excellent development as described before. In the following, a description will be given based on a resistance value which is given by the expression (4).

Figure 7:
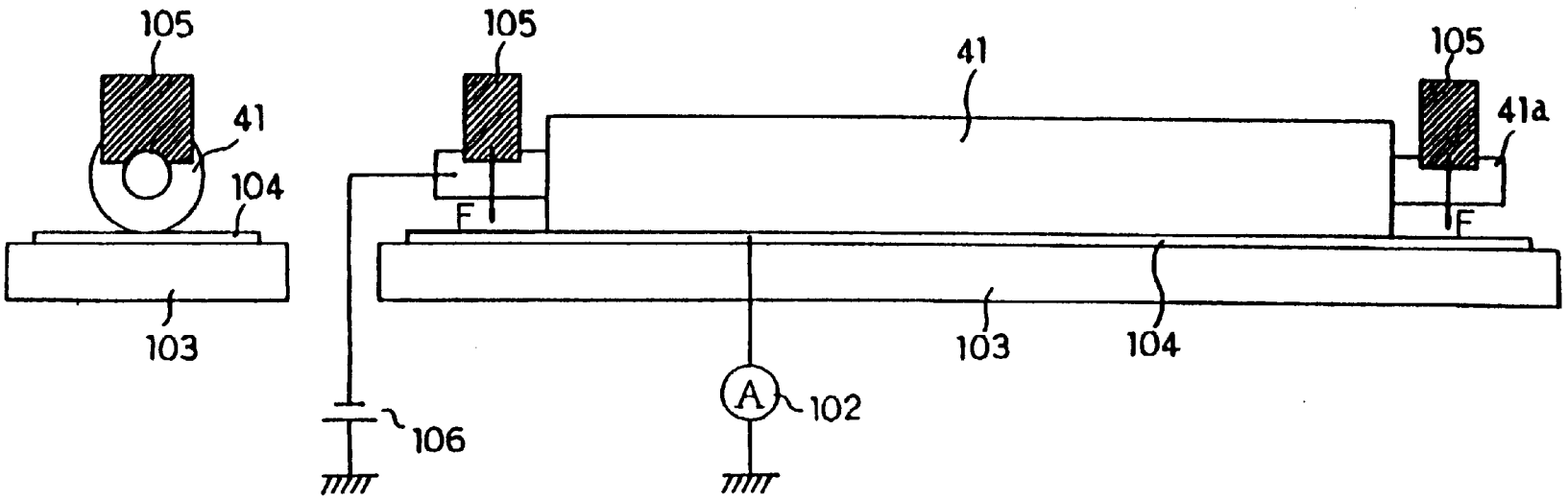
FIG. 7 is a view for describing an apparatus for measuring the value of static resistance of a developing roller which constructs the developing apparatus of the invention.

FIG. 7 shows a measurement apparatus which describes a simple apparatus for measuring the resistance value of the developing roller 41 composing the developing apparatus according to the invention. This resistance value is one which is measured in a status where the developing roller is pressed to the photoconductor 1.

In FIG. 7, the simple apparatus for measuring the resistance value of the developing roller 41 applies load F to portions of the axis 41*a* on both sides of the developing roller 41 by using a weight 105, with the developing roller 41 being placed on a metal detection electrode 104 which is positioned on an insulative flat plate 103. In this status, a constant voltage is supplied from a power 106 to the axis 41*a* of the developing roller 41 and a current which flows in the detection electrode 104 is measured by the ammeter 102. As a result, the resistance value of resistance (Rb) by the developing roller 41 in the status of being pressed can be given by a supplied voltage and a flowing measured current.

In this case, when nonuniformity is present in resistance values, an average value which is given by measuring some points in the peripheral direction is regarded as the typical value of the resistance value of the developing roller 41. Therefore, after measurement in the status of FIG. 7, measurement is conducted rotating by a predetermined angle under the same condition.

Figure 8:
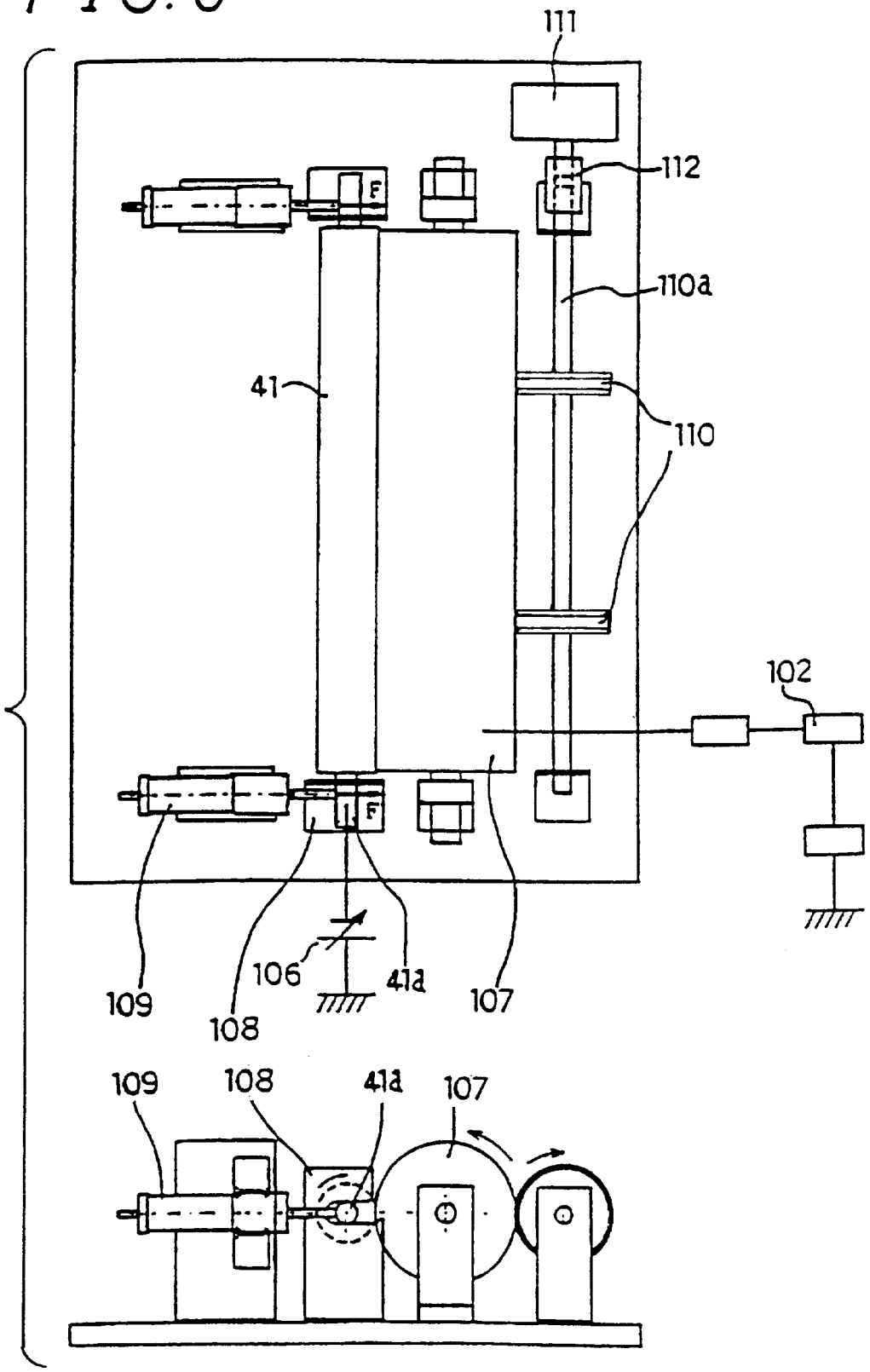
FIG. 8 is a block diagram of an apparatus for measuring resistance variations in the circumferential direction of the developing roller which constructs the developing apparatus of the invention.

On the contrary, FIG. 8 shows an apparatus which can measure resistance values of the entire perimeter in the peripheral direction of the developing roller 41 by actually rotating the developing roller 41. The principle is the same as described with reference to FIG. 7. That is to say, the axis 41*a* is supported at both ends thereof by a supporting member 108 in a manner that the developing roller can move toward the detection electrode 107 in order to cause the developing roller to be pressed to a roller-shaped detection electrode 107 which is supported so as to rotate, and the developing roller 41 is caused to be pressed to the detection electrode 107 by pressure mechanisms 109 corresponding to both the ends of the axis 41*a*. A driving roller 110 which is pressed to cause the detection electrode 107 to rotate is disposed on the opposite side to the pressure mechanisms 109. The rotation force of a motor 111 is transmitted to an axis 110*a* of the driving roller 110 via a transmission mechanism 112, whereby this driving roller 110 is rotated. Accordingly, the developing roller 41 is driven to rotate in accordance with rotation of the detection electrode 107.

In the above configuration, the developing roller 41 is pressed to the detection electrode 107 at a predetermined pressure F by use of the pressure mechanism 109. The diameter of the detection electrode 107 is set to the same diameter of the photoconductor 1 to be actually used, and the pressure F is set to be the same as a pressure for making the developing roller press to the photoconductor. Besides, the contact area (S1) of a nip portion which is formed when the developing roller 41 is pressed to the detection electrode 107 is set to the same area which is formed when the developing roller is pressed to the actual photoconductor 1. Then, the motor 111 is rotated to cause the developing roller 41 to rotate for predetermined times of rotation.

In this status, a bias voltage is supplied from the power circuit 106 to the rotation axis 41*a* of the developing roller 41 and measurement is performed by the ammeter 102 which is connected between the detection electrode 107 and the ground, whereby a resistance value can be found. Accordingly, the resistance value of the developing roller 41 in the invention can be measured in a condition which is close to a working status.

An example in which a variety of developing rollers are used in order to examine an effect of a resistance value of the developing roller by the invention will be described below.

EXAMPLE 2

With reference to a resistance layer of the developing roller 41 such as two kinds of electronically conductive type developing rollers (A, B) which are made by dispersing carbon black in a urethane resin and one kind of ion conductive type roller (C) whose base is a urethane resin, resistance nonuniformity in the peripheral direction is measured by using the measurement apparatus as shown by FIG. 8, and the average value, the largest value and the smallest value of the resistance values of resistance (Rd) with reference to the respective rollers are shown in Table 2. The resistance values were given by measuring a current value when a voltage of 10 V was supplied, by the ammeter 102 of R6871 manufactured by Advantest.

TABLE 2

| Developing roller | Average resistance value | Largest resistance value | Smallest resistance value |
|---|---|---|---|
| A | 2.13 | 20.4 | 0.40 |
| B | 0.27 | 0.48 | 0.15 |
| C | 12.3 | 12.9 | 11.7 |

(The unit of a resistance value in the above table is MΩ.)

The outer shape of the developing roller 41 is described in the example 1, wherein the outer diameter is 34 mm, the thickness Dd of the resistance layer 46 is 8 mm, the length in the axial direction is 320 mm, and the nip width formed when the pressure F is 1 kg is about 1.5 mm.

As for the respective developing rollers A through C as shown in Table 2, the average resistance value is low as a whole specifically in the developing rollers A and B, while the average resistance value is high in the developing roller C. Although the average resistance value of the developing roller A is larger than that of the developing roller B, the largest value of the developing roller A is more than 50 times the smallest value thereof. On this point, in the developing roller C which has a high average resistance value, nonuniformity in resistance values is quite small in the peripheral direction.

Figure 9:
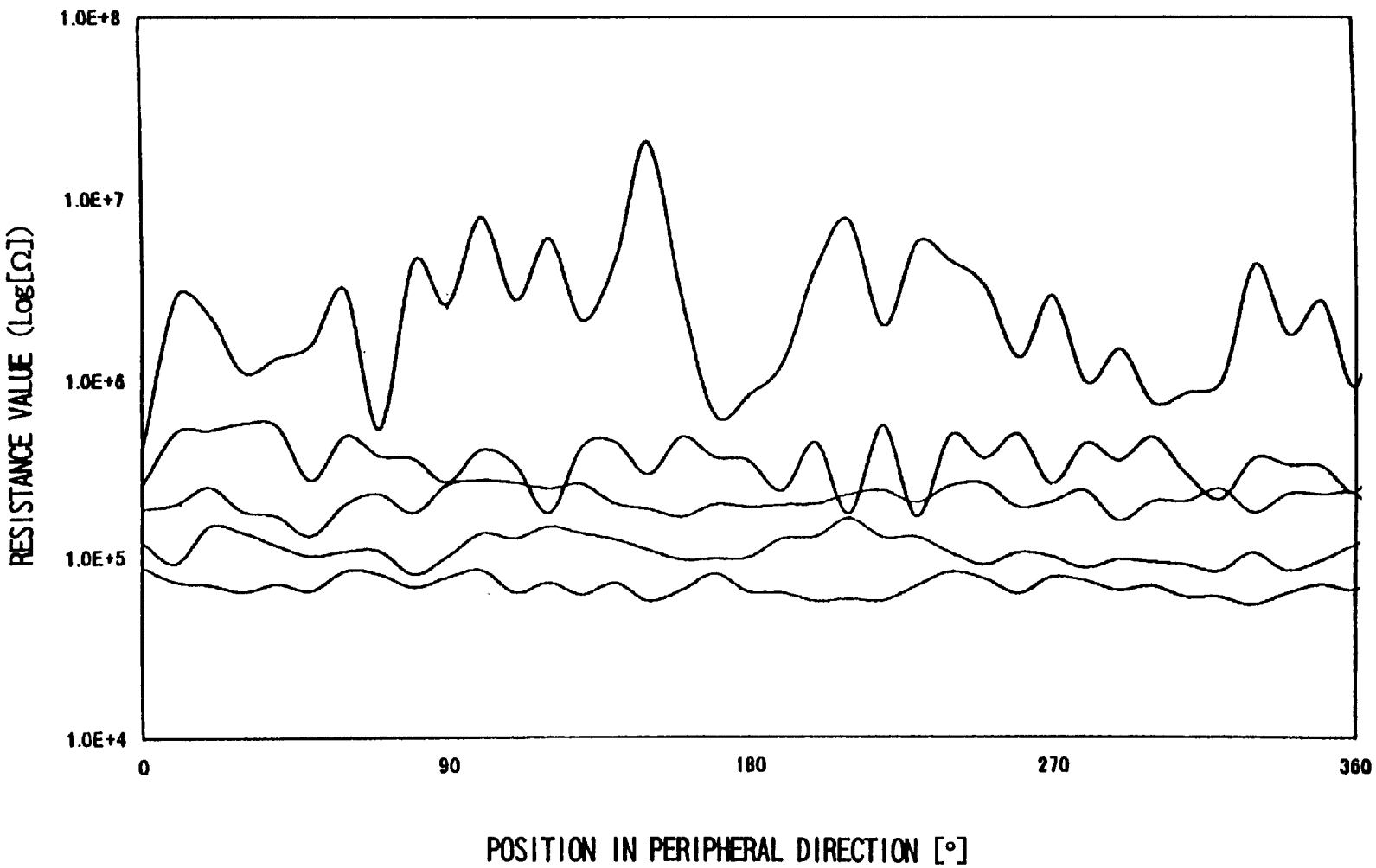
FIG. 9 is a graph showing the result of measuring resistance variations in the circumferential direction of the developing roller which constructs the developing apparatus of the invention.

As for the developing roller A as shown in Table 2, five kinds of electronically conductive type developing rollers in which carbon black is dispersed, are manufactured by changing the resistance value. FIG. 9 shows a status where the results of measuring resistance nonuniformity of the rollers in the peripheral direction by the measurement apparatus as shown by FIG. 8 are plotted. FIG. 9 is a graph, wherein the vertical axis takes a rotation angle (a position in the peripheral direction) of the developing roller 41 and the horizontal axis takes a resistance value. As shown in Table 2, in the developing rollers of developing roller A type, the variations of the resistance value between the largest value and the smallest value is large when the resistance value is made to be high. It appears that the variations of resistance value are stabilized when the resistance value is made to be low.

It is apparent that a portion exceeding $10^7$ (Ω) is present in the case of a roller as shown in FIG. 9 whose average resistance value is the highest. As a result of developing an image of middle tone which was entirely gray by using the developing roller whose resistance value was over $10^7$ (Ω), such a phenomenon occurred that the density of the image got faint in a region where the resistance value was high. This phenomenon results from that a voltage drop was caused by a development current in the semiconductive layer of the developing roller and an execution developing bias voltage was decreased. This phenomenon largely depends on the resistance value of the semiconductive layer 46 of the developing roller and a threshold value thereof varies to a greater or less degree in accordance with a process speed and so on. In the case of the developing apparatus according to the invention, it is distinguishable when the resistance value is over $10^7$ (Ω), while it is ignorable when the resistance value is less than $10^7$ (Ω).

Accordingly, when the developing roller A as shown in Table 2 was used, a large resistance value was partially indicated, but the development nonuniformity or the like as shown before was not caused. Further, in the case of the developing roller B, it was possible to obtain an excellent result of development without causing development nonuniformity. Furthermore, when the developing roller C having a stable resistance value was used, the entire image which was developed got quite faint because of the high resistance value. In the case of the roller as shown in FIG. 9 having a large resistance value, development nonuniformity was outstanding at a portion where a large resistance value was indicated. Therefore, when the largest value in the developing roller 41 is less than $10^7$ (Ω), nonuniformity is caused but ignorable. As for the smallest value, it is possible to use the developing roller 41 which indicates a resistance value which is more than $10^4$ (Ω) as mentioned above.

Therefore, according to the invention, when such a developing roller 41 is used that the resistance value is more than $10^4$ (Ω) and less than $10^7$ (Ω) as mentioned above and such toner is used that the resistance Rt (resistance value of a toner layer) is equal to or more than $5\times10^7$ (Ω), it is possible to realize excellent development without causing degradation in quality of image. In this case, it becomes possible to expect more stable development by preferably setting the upper limit value of the resistance (Rd) of the developing roller 41 at $5\times10^6$ (Ω) or less.

Thus, in the case where the resistance value of the developing roller 41 is regulated to a predetermined range and is less than $10^7$ (Ω) of the upper limit value even when variations of the resistance value are generated, stable development is realized by tradeoffs with the resistance value Rt of a toner layer. Therefore, even when nonuniformity is generated in the resistance value of the developing roller 41, as long as it is within the regulation range, it is ignorable and excellent development can be expected a lot.

The resistance value of the developing roller 41 is a value under the standard measurement condition in conformance with JISZ-8703. On the contrary, a resistance value varies under a condition of high temperature and high humidity of 35° C. and 85% RH or under a condition of low temperature and low humidity of 5° C. and 20% RH. As a result, it can be considered that a development characteristic varies.

Therefore, according to the invention, in the case where a urethane resin is used as a semiconductive layer of the developing roller 41 composing the developing apparatus, the result of measuring moisture absorptivity and a resistance value in conformance with JISK-7209A is that as for a urethane base whose moisture absorptivity is 2–5%, the resistance value varies by one or two orders of magnitude under a condition of high temperature and high humidity and a condition of low temperature and low humidity. On the contrary, the resistance value varies by a half or one order of magnitude at most as for a urethane base whose moisture absorptivity is 0.5–1%, so that variations of developing amount in accordance with change of a resistance value is a little and hence excellent quality of image can be maintained.

(Another Embodiment of the Invention)

As mentioned before, in the invention, in the case where such toner that the resistance value Rt of a toner layer is equal to or more than 50 MΩ, preferably equal to or more than 100 MΩ is used in a status where the resistance value of the developing roller 41 is set within a regulated range, it is possible to expect excellent development without degradation in quality of image. However, when an experiment is executed under various conditions, degradation in quality of image sometimes occurs. The result of analyzing a factor based on the conditions of an experiment in which degradation in quality of image occurs will be described below.

In specific, it was found that stability in development was not ensured only by regulating the resistance value Rt of a toner layer and largely depended on the resistance value even when the resistance value of the developing roller 41 was set within the above-mentioned range.

Therefore, the thickness of a toner layer is regulated within a setting range of 10–30 μm. In the case of exceeding this regulated range, quality of image was often degraded. In a case where a toner layer is less than 10 μm, the toner layer is thin as apparent from the expression (6). Hence, even when the same voltage is applied to the toner layer, an electric field strength increases and such a risk increases that the toner layer is electrically broken at a portion of the blade 43 and a development portion which comes into contact with the photoconductor 1, whereby quality of image is degraded. In a case where a toner layer is more than 30 μm, the charge characteristic of the toner layer is degraded and a phenomenon such as a development ghost and fogging occurs, with the result that quality of image is largely degraded.

Accordingly, it is possible to realize more stable development by regulating the layer thickness of a toner layer within 10–30 μm as mentioned above.

In a case where a bias voltage supplied to the respective members is too high, quality of image is degraded due to an electrical breakdown of a toner layer. As shown in Table 1, the measured voltage of causing an electrical breakdown of a toner layer was 400–500 V with respect to the thickness of a toner layer of 20 μm. Accordingly, by the expression (6), the electric field strength Et on the electrical breakdown is 20–25 (MV/m). The result showed that it was important to set the upper limit of a voltage supplied to a toner layer sandwiched by low-resistance materials to be 20 (MV/m) and regulate it to be 20·Dt2 (V). Thus, a voltage supplied to the supplying roller 42, the blade 43 and the charge removing member 44 which come into contact with the developing roller 41 is set at 20·Dt2 (V) or less as mentioned above, whereby it is possible to regulate the layer thickness of a toner layer and prevent development from being degraded due to an electrical breakdown of a toner layer.

In a case where the resistance value of the respective members to which a bias voltage is supplied, specifically the developing roller 41, the supplying roller 42, the blade 43 and the charge removing member 44, is low, it is possible to further enlarge the aforementioned upper limit. In other words, it is possible to further raise the upper limit. However, in the developing apparatus according to the invention, all the developing roller 41, the supplying roller 42, the blade 43 and the charge removing member 44 are composed of a low-resistance material, so that it is possible to realize excellent development by determining the upper limit for each member.

The developing bias voltage Va is supplied to the developing roller 41, the bias voltage Vc to the supplying roller 42, the bias voltage Vb to the blade 43, and the voltage Vd to the charge removing member 44. Therefore, it is only required to set the respective bias voltages so that the absolute values of the differences between the developing bias voltage Va supplied to the developing roller 41 and the respective bias voltages supplied to the supplying roller 42, the blade 43 and the charge removing member 44 become equal to or less than 20·Dt2 (V) as described above.

(Another Embodiment of the Above Embodiment of the Invention)

Next, the blade 43 for regulating a toner layer, the supplying roller 42 and the charge removing member 44 which compose the developing apparatus according to the invention will be described.

In specific, there is a difference between a characteristic after development of a white portion and a characteristic after development of a black portion, which characteristic is related to a development characteristic such as specific charge and the toner mass per unit area of the toner layer 45 formed on the developing roller 41 and the supplying roller 42. Resulting in this, such a developing ghost problem is brought that a difference in development amount is generated in the rotation period of the developing roller 41 and the supplying roller 42 and a difference in image density is generated.

Figure 10:
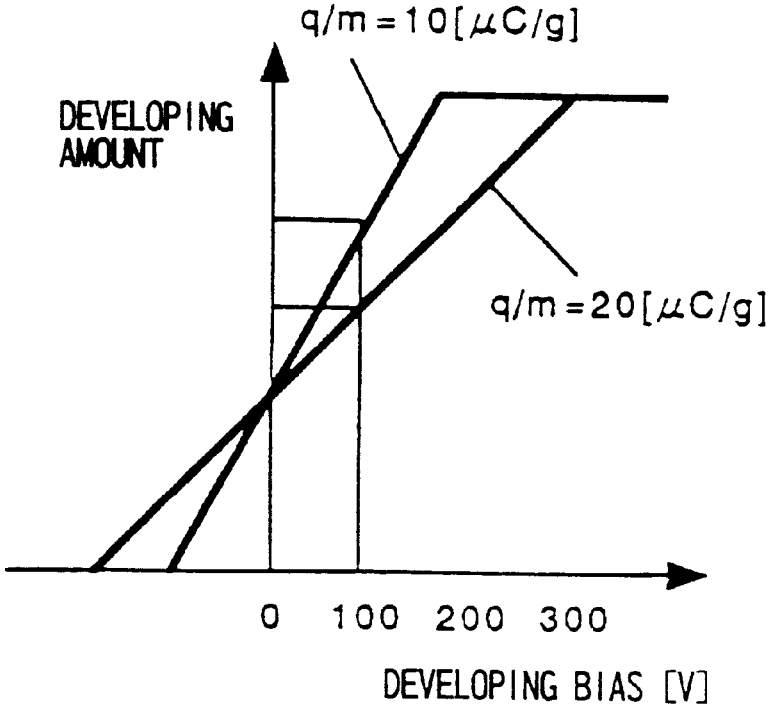
FIG. 10 is a graph for describing a development characteristic when specific charge of toner is regarded as a parameter in the developing apparatus based on the invention.

FIG. 10 shows a development characteristic when specific charge q/m is regarded as a parameter. For instance, it is apparent that around 100 V of a middle tone development potential, the developing amount in high specific charge is less than the developing amount in low specific charge. In a case where refresh of toner on the developing roller after development is insufficient, toner after development of a white portion remains on the developing roller to be collected without being used for the development. Therefore, friction charge or the like is repeated between the toner and the charge removing member 44 and the toner is made into small-size particles, with the result that specific charge thereof gets high in general. Accordingly, the middle density of white portion development degree gets lighter than that of black portion development degree, which is so-called a posighost.

Figure 11:
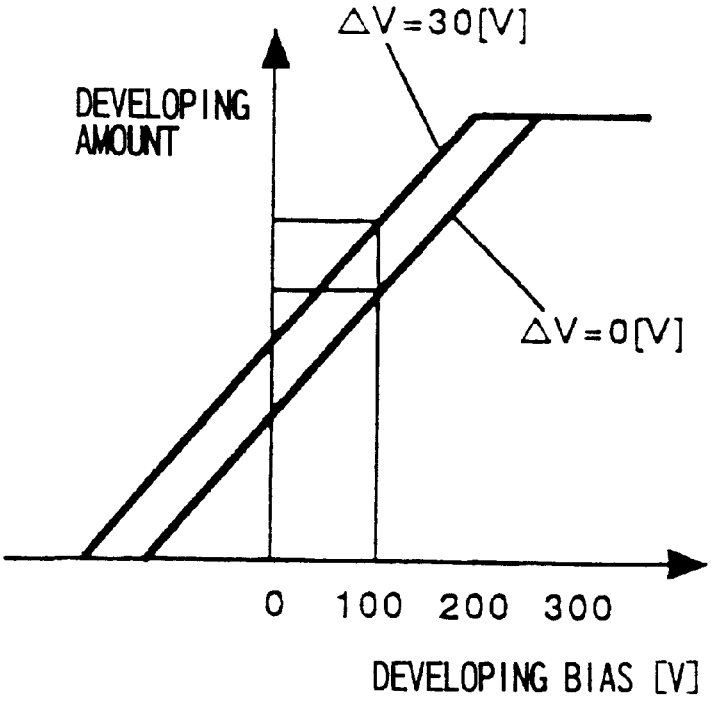
FIG. 11 is a graph for describing a development characteristic when the amount of rise of a surface potential of the developing roller which constructs the developing apparatus of the invention is regarded as a parameter.

FIG. 11 shows a development characteristic when the rising amount ΔV of a surface potential on the developing roller 41 is regarded as a parameter. It is found that the graph shifts to the left when the surface potential rises. Therefore, it is apparent by looking at around 100 V of a middle tone development potential that a developing amount increases as a surface potential rises. In a case where for a certain reason, charge which is deposited on the surface of the developing roller does not pass through the semiconductive layer 46 of the developing roller 41 and flee via the rotation axis 41*a*, the surface potential of the developing roller 41 rises. Whether the surface potential of the developing roller rises or not is dependent on the magnitude relation between a time constant which is determined by the resistance value and capacitance of the developing roller, and a process speed.

On this point, since the resistance value of the developing roller composing the developing apparatus according to the invention is minimized, the possibility of occurrence of a developing ghost which results from accumulation of charge on the surface of the developing roller 41 is reduced in the case where the peripheral speed of the developing roller 41 is about 285 mm/sec. However, there remains a concern that quality of image is degraded when the same phenomenon that a surface potential rises is brought to the supplying roller 42, the blade 43 and the charge removing member 44.

On the contrary, as for the supplying roller 42, the rotation speed of the supplying roller 42 is determined on the basis of the ratio of a peripheral speed thereof with that of the developing roller 41 being selected between 0.5 and 2.0. In addition, the resistance value is determined by a force for being pressed to the developing roller 41, a contact nip area determined by sponge hardness, and volume resistivity. As a result of executing an experiment by changing these conditions, it is found that the surface potential can be prevented from rising when the resistance value is 100 (kΩ) or less. Thus, it is possible to solve the problem of a ghost phenomenon.

Further, in the case where a leaf spring blade made of metal is used as the blade 43 for regulating a toner layer, the potential of the blade surface does not rise on principle. However, in the case where a resin material of high resistance or the like is coated, the potential rises and uniformity of the toner layer is impaired. The blade 43 is a stationary member, and it depends on the speed of charge accumulation and the time constant of the member whether the surface charge rises or not. Since this speed of charge accumulation is largely dependent on an electric characteristic of toner, a logical numerical value thereof is unknown. However, as a result of an experiment executed within the range of the resistance value Rt of the toner layer and the resistance value (Rd) of the developing roller 41 including the respective toners as shown in the example 1, it is found that selection of a coating material having a resistance value of 10 (kΩ) or less is preferable when the blade 43 is coated thereby. Thus, it is possible to realize uniformity of the toner layer 45 and conduct excellent development, and it is also possible to solve a problem such as a ghost. In the case of forming the blade 43 by using a metal blade without applying a coating process, the aforementioned problems do not occur.

Furthermore, the charge removing member 44 is standing still as well as the blade 43. Therefore, it was experimentally confirmed that a problem of rise of the surface potential is solved when the charge removing member is made of a resin material having a resistance value of 10 (kΩ) or less which is lower than that of the supplying roller 42.

In a case where the supplying roller 42 which comes into contact with the developing roller 41 can sufficiently satisfy both a function of removing a toner layer after development and a function of supplying fresh toner, a development ghost can be prevented. However, since a bias voltage in a direction of supplying toner to the developing roller 41 is supplied to the supplying roller 42, removal of a toner layer after development becomes just a mechanical action, which removal has a limit. Further, when the removed toner remains on the supplying roller 42, the function of supplying toner is impaired. Accordingly, it is difficult to accomplish the two functions as mentioned above at a satisfactory level by using a single member of the supplying roller 42.

In the developing apparatus as shown by FIG. 1, a charge removing voltage, for example, a voltage of about −200 V is supplied by the power circuit 14 to the charge removing member 44 made of a conductive resin film. By additionally disposing this charge removing member 44, the toner layer after development is removed by an electric force and hence it is possible to separate the functions. Therefore, such a load of removing toner which is deposited on the developing roller 41 by the supplying roller 42 is reduced, and an effect of preventing a development ghost is increased. It is only required to set the charge removing voltage supplied to the charge removing member 44 within a range where the toner layer is not electrically broken, an optimal value of the charge removing voltage being different for each toner to be used.

(Another Embodiment of the Invention)

In the respective embodiments as described above, for the purpose of preventing an overcurrent and preventing quality of image from being degraded by development in the status of an electrical breakdown of a toner layer, the resistance value of the developing roller and the resistance value of the toner layer are regulated. In addition, it has been explained that the resistance value of the developing roller 41 is set within a range of low value in order to avoid a ghost phenomenon, and the ranges of the resistance values of the respective members which come into contact with the developing roller have been described, which members are the supplying roller 42, the blade 43 and the charge removing member 44 in the embodiments of the invention.

With reference to the developing roller 41 composing the developing apparatus according to the invention, the resistance value is set to be low as mentioned above. At this time, there remains a concern about a development failure due to an overcurrent. In specific, in the case where the layer thickness of the toner layer 45 and the resistance value (Rt) of the toner layer are within the regulated ranges, there is no problem. However, in the case where uniformity of the toner layer is disturbed due to another factor, an overcurrent may occur. An embodiment for effectively preventing this will be described below.

In the embodiments as described above, as a method for preventing an overcurrent by use of the developing roller 41 of low resistance, the resistance value of the toner layer is regulated. Further, the layer thickness of the toner layer is regulated, whereby an overcurrent is prevented and excellent development is conducted. Still further, bias voltages which are supplied via the respective members coming into contact with the developing roller 41 and a difference in the bias voltages are regulated, whereby an overcurrent is prevented.

However, the toner layer may be impaired due to an unexpected cause such as the mixing of a foreign matter into the developing apparatus. As a result, there is a possibility that an overcurrent occurs. Overcurrent protection as a measurement for this will be described below.

Figure 12:
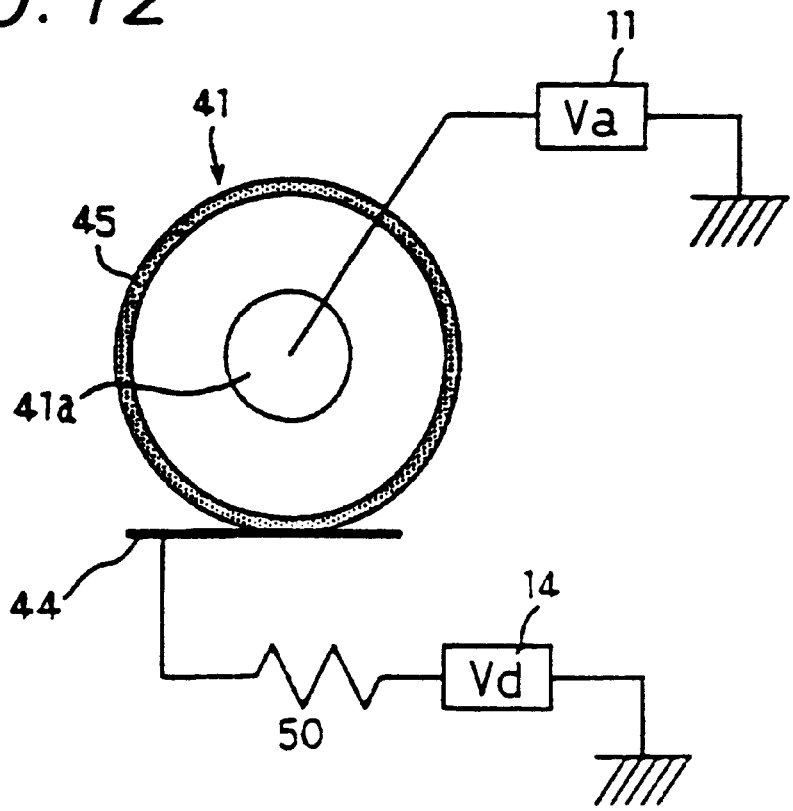
FIG. 12 is a view showing the configuration of a charge removing section after development which is an example for describing a protection resistor which is used in the developing apparatus based on the invention for protecting an overcurrent.
Figure 13:
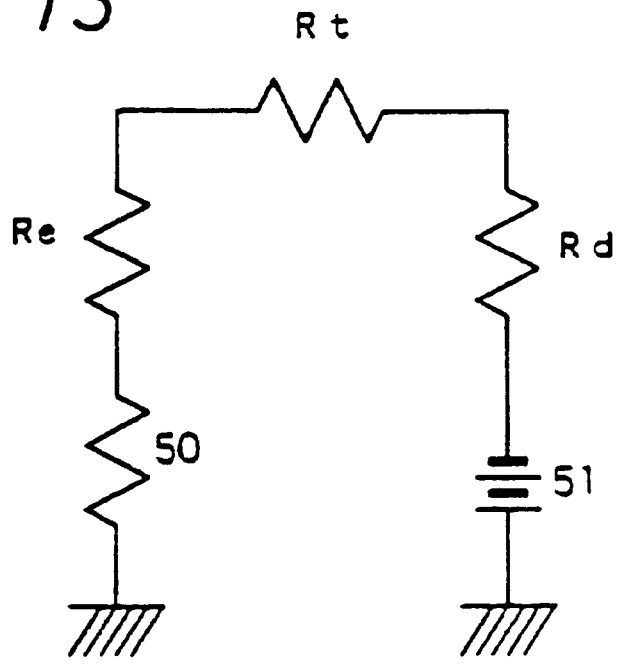
FIG. 13 is an equivalent circuit of the charge removing section as shown by FIG. 12.

FIG. 12 shows a configuration that a bias voltage (Vd) from a power circuit 14 is supplied to the charge removing member 44 via a resistor 50. In this case, the resistance value of the resistor 50 for an overcurrent protection is significantly important. Therefore, in order to describe the resistance value of the resistor 50, FIG. 13 shows an electrically equivalent circuit to FIG. 12.

A potential difference between the developing bias voltage Va supplied to the developing roller 41 and the bias voltage Vd supplied to the charge removing member 44 is a voltage source 51 as shown in FIG. 12, and the resistance Rd of the semiconductive layer, the resistance Rt of the toner layer, the resistance Re of the charge removing member 44 and the resistor 50 for protection are connected in series.

The resistance value of the resistance Rd of the developing roller 41 and the resistance value of the resistance Re of the charge removing member 44 are set to be enough lower than the resistance value of the resistance Rt of the toner layer. In general, almost all the bias voltage (51) to be supplied is applied to the toner layer 45 and a flowing current value is minute. However, since the entire resistance is low in the case where the protection resistor 50 is not present, an overcurrent flows, toner fusion occurs and a member damage is caused in the developing roller and the charge removing member 44 when the toner layer is impaired and the resistance value of the resistance Rt of the toner layer is extremely decreased apparently.

In the case where the protection resistor 50 is inserted in series as shown in FIG. 12 (refer to the equivalent circuit of FIG. 13), even when the apparent resistance value of the resistance Rt of the toner layer is lowered, almost all the voltage (51) applied to the members comes to be applied to the protection resistor 50 and an overcurrent can be prevented as long as the protection resistor 50 is set to be enough larger than the resistance Rd of the developing roller 41 and the resistance Rc of the charge removing member 44.

Accordingly, in order to minimize an overcurrent, it is only required to set the resistance value of the protection resistor 50 to be large. However, in the case where the resistance value of the protection resistor 50 is too large, a supplied voltage is divided at the toner layer 45 and the protection resistance 50 in the normal status, and a voltage which is applied to the toner layer 45 becomes small due to a voltage drop caused by the protection resistor 50. When it happens, an effect of the bias voltage (Vd) which is expected at first is decreased. Therefore, it is rather important to select the voltage value of the protection resistor 50, a proper value of which will be described below.

While it is described in FIG. 12 that the protection resistor 50 is disposed between the charge removing member 44 and the power circuit 14, the same protection resistor may be inserted as necessary between the supplying roller 42 and the power circuit 12, and between the blade 43 and the power circuit 13. Using these protection resistors 50 or the like, the range of the resistance value will be described below.

A developing current Id (A) which is generated when charged toner transfers from the developing roller 41 to the photoconductor 1 is given by expression (7) as shown below:

$$Id=q/m\cdot m/a\cdot l\cdot v \tag{7}$$

wherein m/a (kg/m$^2$) is a toner mass per unit area on the photoconductor 1 after development, q/m (C/kg) is a specific charge of the toner, l (m) is an effective width of an image, and v (m/sec) is a peripheral speed of the photoconductor.

For instance, in the case where the toner mass per unit area on the photoconductor after entire black development is 1.0 mg/cm$^2$, the specific charge of the toner is −20 $\mu$C/g, the effective width of an image is 300 mm, and the peripheral speed of the photoconductor 1 is 190 mm/sec, the absolute value of the developing current is 11.4 $\mu$A according to the expression (7). This current value at the time of entire black development is the largest value of the developing current.

This developing current Id is generated by toner transfer in a developing portion (a region where the developing roller 41 and the photoconductor 1 come into contact with each other) The same idea can be applied to the supplying roller 42, the blade 43, and the charge removing member 44 which come into contact with the developing roller 41. A voltage drop Vr of the protection resistors 50 or the like which is caused by a toner transfer current Ir is given by expression (8) as shown below on the basis of the resistance value Rr of the protection resistors 50 or the like:

$$Vr=Ir\cdot Rr \tag{8}$$

Unless this voltage drop Vr is sufficiently small with respect to a bias voltage to be supplied, a voltage which is actually applied to the toner layer 45 becomes small, so that a bias effect is decreased. Therefore, the upper limit value (Rr) of the protection resistors 50 or the like is determined by the acceptable extent of a voltage drop caused by a toner transfer current in the normal status. The upper limit value (Rr) of the respective protection resistors 50 or the like is determined by the acceptable extent of an overcurrent under an abnormal condition.

As a result of tests executed by using a variety of toners, it was experimentally confirmed that the value of specific charge of toner which could be practically used was −5 through −30 $\mu$C/g, preferably −10 through −20 $\mu$C/g in the case of using negatively charged toner. The toner mass per unit area on the photoconductor 1 which is necessary for black development is approximately 1.0 mg/cm$^2$, the toner mass per unit area varying more or less in accordance with a concealing characteristic of the toner. The effective width l (m) of an image and the peripheral speed v (m/sec) of the photoconductor are design variables. Therefore, when the specific charge of −30 $\mu$C/g and the toner mass per unit area of 1.0 mg/cm$^2$ are substituted into the expression (7), the largest transfer current Imax (VA) which is assumed in practical use is given by expression (9) as shown below:

$$I\max=300\cdot l\cdot V \tag{9}$$

Then, in the case where the upper limit of the acceptable value of an overcurrent which does not bring toner fusion or a member damage is set to be n times the largest transfer current, the lower limit value Rmin (Ω) of the protection resistor 50 is given by expression (10) as shown below on the basis of the expressions (8) and (9):

$$R\min=V/(300\cdot n\cdot l\cdot v) \tag{10}$$

"V" used in the expression (10) is a difference between a bias voltage supplied to the developing roller 41 and a surface potential of the photoconductor 1 which is a member contacting the developing roller as shown by FIG. 13.

At the charge removing member 44, a voltage cannot be kept by the toner layer 45 and an overcurrent is likely to flow, because toner remains little on the developing roller 41 after black development. However, since this overcurrent does not flow inside of the toner layer but directly flows between the developing roller 41 and the charge removing member 44, the upper limit of the acceptable value becomes slightly larger as compared with the supplying roller 42 and the blade 43. As a result of actually executing a development test with 10–50 thousands sheets by selecting several protection resistor values based on the expression (10), a problem of development degradation and so on caused by an overcurrent was solved by setting n=5 in the case of the supplying roller 42 and the blade 43 and setting n=10 in the case of the charge removing member.

Accordingly, the minimum value of a protection resistor inserted to the charge removing member 44, the supplying roller 42 and the blade 43 is given by substituting the above-said value "5" or "10" into "n" in the expression (10). "V" of the expression (10) is a potential of a difference between the developing bias voltage (Va) and the charge removing bias voltage (Vd) as for the charge removing member 44, a difference between the developing bias voltage and the supplying bias voltage (Vc) as for the supplying roller 42, and a difference between the developing bias voltage and the regulating bias voltage (Vb) as for the blade 43.

As a result of a variety of experiments by using toner having such characteristics as the above-mentioned specific charge, toner mass per unit area and layer thickness and by changing a voltage supplied to the respective members, it was concluded that a potential difference applied to the toner layer was at least 40 V. It is possible to handle such a case by previously supplying a large bias voltage which is commensurate in size with a voltage drop at the protection resistor portion. On the assumption that the electrical breakdown voltage of the toner layer 45 is approximately 400 V, in the case where a set potential difference is 40 V, a margin of voltage with respect to the electrical breakdown of the toner layer is 10 times at most and the acceptable amount of voltage drop at the protection resistor portion is 360 V. Thus, it becomes possible to set the range of the protection resistor to be large. Therefore, even when nonuniformity is unexpectedly caused in the toner layer, it is possible to prevent an overcurrent and conduct excellent development.

Further, as mentioned with reference to the expression (9), the reason for calculating the largest value of a transfer current of a toner layer is that the largest value of specific charge of toner which can be practically used is 30 $\mu$C/g and the toner mass per unit area on the photoconductor 1 which is necessary for black development is about 1.0 mg/cm$^2$. However, the supplying roller 42 has the function of removing toner on the surface of the developing roller 41 after development and the function of charging toner in the developing tank 40 and applying it to the developing roller 41. Therefore, at a mechanism for removing the toner on the developing roller 41 after development, a reverse current flows and hence the largest current becomes smaller than the largest developing current at a developing position. As a result of measuring a current which actually flowed at the supplying roller 42, the current was one fifths of the largest developing current or less. Accordingly, the upper limit value Rmax (Ω) of the protection resistor at the supplying roller 42 is given by expression (11) as shown below on the basis of the expressions (8) and (9):

$$R\max=6/(l\cdot v) \tag{11}$$

Next, the blade 43 will be studied. As for this blade 43, it can be considered that since toner is previously applied onto the surface of the developing roller 41 from the supplying roller 42, the transfer amount of toner is little and a toner charge current is dominant. Therefore, the largest current there is smaller than the largest developing current of a developing portion. As a result of measuring a current which actually flowed at the blade 43, the current was one thirds of the largest developing current or less.

Further, on the developing roller 41 after white development, almost the same amount of toner remains as before development. In the case where this toner is to be electrically removed by the charge removing member 44, the largest current Imax as shown by the expression (9) flows. However, as a practical matter, it is more effective that refresh of toner remaining on the developing roller is accomplished by a balance between the electrical removal and a mechanical removal by the supplying roller 42. Therefore, a removing bias voltage is set to be lower and the removal amount of toner at a charge removing portion is set so as not to be 100%. Thus, a charge removing current becomes lower than Imax. Besides, in the case where the charge removing member 44 is a fixed member like a sheet, removed toner is not efficiently conveyed into the developing tank 40, with the result that the charge removing current becomes small. As a result of measuring a current which actually flowed at the charge removing member 44 after white development, the current was one thirds of the largest developing current Imax or less.

Accordingly, the upper limit values Rmax (Ω) of the protection resistors at the blade 43 serving as a toner layer regulating member and at the charge removing member 44 are given by expression (12) as shown below on the basis of the expressions (8) and (9):

$$R\max=3.6/(l\cdot v) \tag{12}$$

It has been a well-known idea previously to prevent an overcurrent to be generated between the developing roller 41 and the photoconductor 1 by inserting the above-described protection resistor between the developing roller 41 and the power circuit 11 serving as a supply source of the developing bias voltage. However, the following side effect is generated in this case.

For instance, as a developing amount varies in accordance with the black and white ratio of an image, a developing current varies. Then, the amount of voltage drop at the portion of the developing roller 41 varies in accordance with the black and white ratio. As a result, density nonuniformity associated with the black and white ratio becomes distinguishable specifically in the quality of image of middle tone. For the purpose of solving this problem, in the developing apparatus according to the invention, the developing roller 41 of low resistance was used and the protection circuit 50 was inserted between the charge removing member 44 and the power circuit 14 as shown in FIG. 12 without inserting the protection resistor between the developing roller 41 and the power circuit 11. Besides, as a result of experimentally examining the largest potential difference applied to the toner layer at the development portion, it was found that the risk of an overcurrent with respect to the photoconductor 1 could be avoided by setting the largest potential difference at 400 V or less.

Accordingly, in the invention, the protection resistor is disposed between the supplying roller 42 and the power circuit 14 supplying thereto, or between the charge removing member 44 and the power circuit 12 supplying thereto, or between the blade 43 and the power circuit 13 supplying thereto as shown in FIG. 12, whereby an overcurrent can be prevented even when the aforementioned potential difference is enlarged, a range in which the protection resistor can be set is enlarged, an overcurrent is prevented from occurring, and excellent development is realized.

Further, without inserting the protection resistor between the developing roller 41 and the power circuit 11, the developing bias voltage (Va) is supplied so that a potential difference at a developing portion which comes into contact with the photoconductor 1 becomes 400 V or less as mentioned above, whereby an overcurrent is prevented and stable development is realized. In a case where the surface potential of the photoconductor 1 is, for example, −550 V and the potential at a portion to which a laser light or the like is irradiated is approximately "0", it is required at least to set the developing bias voltage at −400 V or less (in the absolute value).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus using one-component toner comprising:

a developing roller for carrying and conveying one-component toner to a developing region facing an electrostatic latent image bearing member; and a regulating member for regulating at least an amount of the one-component toner carried on the developing roller, wherein the developing roller is formed by covering a conductive shaft with an elastic semiconductive layer, and resistance Rd of the developing roller is defined as follows:

$$Rd=\rho d\cdot(Dd1/S1),$$

and $$10^4<Rd<5\times10^6$$

wherein S1 ($cm^2$) is an area of the developing roller which comes into contact with the electrostatic latent image bearing member via a toner layer formed on a surface of the developing roller after the developing roller passes by the regulating member, Dd1 (cm) is a layer thickness of the semiconductive layer, and ρd (Ω·cm) is a volume resistivity of the semiconductive layer, and resistance Rt (Ω) of the toner layer formed on the developing roller is set as follows:

$$Rt>5\times10^7.$$

2. The developing apparatus using one-component toner of claim 1, wherein the resistance Rt of the toner layer is determined by internal resistance Ri of the one-component toner, contact resistance Rc among toner particles and surface resistance Rs, and defined as follows:

$$1/Rt=1/Rs+1/(Rc+Ri).$$

3. The developing apparatus using one-component toner of claim 1, wherein a layer thickness of the toner layer formed on the surface of the developing roller by the regulating member is set within a range of 10–30 μm.

4. The developing apparatus using one-component toner of claim 1, wherein the semiconductive layer of the developing roller is made of a urethane resin having a moisture absorptivity of 1% or less.

5. The developing apparatus using one-component toner of claim 1, further comprising:

a charge removing member with which the developing roller comes into contact after development, for removing charge of the toner remaining on the developing roller, wherein a protection resistor for preventing an overcurrent is electrically connected to the charge removing member.

6. The developing apparatus using one-component toner of claim 1, further comprising:

a supplying member for removing toner remaining on the developing roller after development and newly supplying toner, wherein a protection resistor for preventing an overcurrent is electrically connected to the supplying member.

7. The developing apparatus using one-component toner of claim 1, wherein a protection resistor for preventing an overcurrent is electrically connected to the regulating member.

* * * * *